US006184453B1

(12) United States Patent
Izumisawa

(10) Patent No.: US 6,184,453 B1
(45) Date of Patent: Feb. 6, 2001

(54) TONE GENERATOR, ELECTRONIC INSTRUMENT, AND STORAGE MEDIUM

(75) Inventor: Gen Izumisawa, Hamamatsu (JP)

(73) Assignee: Kabushiki Kaisha Kawai Gakki Seisakusho, Hamamatsu (JP)

( * ) Notice: Under 35 U.S.C. 154(b), the term of this patent shall be extended for 0 days.

(21) Appl. No.: 09/499,807

(22) Filed: Feb. 8, 2000

(30) Foreign Application Priority Data

Feb. 9, 1999 (JP) ..... 11-031783

(51) Int. Cl.[7] ..... G10H 7/00
(52) U.S. Cl. ..... 84/604; 84/625; 84/626
(58) Field of Search ..... 84/603, 604, 625, 84/626, 645, 660–662

(56) References Cited

U.S. PATENT DOCUMENTS 4,939,973 * 7/1990 Suzuki ..... 84/626 X
5,308,917 * 5/1994 Kitamura et al. ..... 84/626 X
5,686,682 * 11/1997 Ohshima et al. .

FOREIGN PATENT DOCUMENTS 1-257898 10/1989 (JP) .
1-269995 10/1989 (JP) .

* cited by examiner

*Primary Examiner*—Jeffrey Donels
(74) *Attorney, Agent, or Firm*—Christie, Parker & Hale, LLP

(57) ABSTRACT

When a low-pass filter 204 cuts a loud tone component from a waveform signal that soft and loud tone components are synthesized, and outputs a soft tone component signal, and a high-pass filter 205 cuts a soft tone component from the waveform signal that soft and loud tone components are synthesized, and outputs a loud tone component signal, the outputs at this time are switched on the basis of tone information (touch information, pitch information, tone color information, and the like).

27 Claims, 18 Drawing Sheets

FIG. 5

T1

| TONE COLOR | PITCH | ADDRESS | THV | FKL | FKH |
|---|---|---|---|---|---|
| PIANO | 0 ~ 31 | 2000h | 97 | 1 | 2 |
| | 32 ~ 43 | 2010h | 98 | 1 | 2 |
| | 44 ~ 55 | 2020h | 99 | 1 | 2 |
| | 56 ~ 67 | 2030h | 101 | 1 | 2 |
| | 68 ~ 79 | 2040h | 102 | 1 | 0 |
| | 80 ~ 91 | 2050h | 104 | 1 | 0 |
| | 92 ~103 | 2060h | 105 | 1 | 0 |
| | 104 ~115 | 2070h | 106 | 1 | 0 |
| | 116 ~127 | 2080h | 107 | 1 | 0 |
| GUITAR | 0 ~ 31 | 2090h | 80 | 1 | 2 |
| | 32 ~ 43 | 20A0h | 82 | 1 | 2 |
| | 44 ~ 55 | 20B0h | 84 | 1 | 2 |
| | 56 ~ 67 | 20C0h | 86 | 1 | 2 |
| | 68 ~ 79 | 20D0h | 88 | 1 | 2 |
| | 80 ~ 91 | 20E0h | 91 | 1 | 2 |
| | 92 ~103 | 20F0h | 93 | 1 | 2 |
| | 104 ~115 | 2100h | 95 | 1 | 2 |
| | 116 ~127 | 2110h | 97 | 1 | 2 |
| STRINGS | 0 ~ 31 | 2120h | 85 | 1 | 2 |
| | 32 ~ 43 | 2130h | 86 | 1 | 2 |
| | 44 ~ 55 | 2140h | 87 | 1 | 2 |
| | 56 ~ 67 | 2150h | 88 | 1 | 2 |
| | 68 ~ 79 | 2160h | 90 | 1 | 2 |
| | 80 ~ 91 | 2170h | 91 | 1 | 2 |
| | 92 ~103 | 2180h | 92 | 1 | 2 |
| | 104 ~115 | 2190h | 93 | 1 | 2 |
| | 116 ~127 | 21A0h | 94 | 1 | 2 |

FILTER SYSTEM
0:THRU
1:LPF
2:HPF

FIG. 14

T2

| TONE COLOR | PITCH | ADDRESS | THV | FTL | FTH |
|---|---|---|---|---|---|
| PIANO | 0 ~ 31 | 2000h | 97 | 1 | 2 |
| | 32 ~ 43 | 2010h | 98 | 1 | 2 |
| | 44 ~ 55 | 2020h | 99 | 1 | 2 |
| | 56 ~ 67 | 2030h | 101 | 1 | 2 |
| | 68 ~ 79 | 2040h | 102 | 1 | 0 |
| | 80 ~ 91 | 2050h | 104 | 1 | 0 |
| | 92 ~103 | 2060h | 105 | 1 | 0 |
| | 104 ~115 | 2070h | 106 | 1 | 0 |
| | 116 ~127 | 2080h | 107 | 1 | 0 |
| GUITAR | 0 ~ 31 | 2090h | 80 | 1 | 2 |
| | 32 ~ 43 | 20A0h | 82 | 1 | 2 |
| | 44 ~ 55 | 20B0h | 84 | 1 | 2 |
| | 56 ~ 67 | 20C0h | 86 | 1 | 2 |
| | 68 ~ 79 | 20D0h | 88 | 1 | 2 |
| | 80 ~ 91 | 20E0h | 91 | 1 | 2 |
| | 92 ~103 | 20F0h | 93 | 1 | 2 |
| | 104 ~115 | 2100h | 95 | 1 | 2 |
| | 116 ~127 | 2110h | 97 | 1 | 2 |
| STRINGS | 0 ~ 31 | 2120h | 85 | 1 | 2 |
| | 32 ~ 43 | 2130h | 86 | 1 | 2 |
| | 44 ~ 55 | 2140h | 87 | 1 | 2 |
| | 56 ~ 67 | 2150h | 88 | 1 | 2 |
| | 68 ~ 79 | 2160h | 90 | 1 | 2 |
| | 80 ~ 91 | 2170h | 91 | 1 | 2 |
| | 92 ~103 | 2180h | 92 | 1 | 2 |
| | 104 ~115 | 2190h | 93 | 1 | 2 |
| | 116 ~127 | 21A0h | 94 | 1 | 2 |

FILTER TYPE
0:THRU — 1
1:LPF — 2
2:HPF — 3
⋮ ⋮

TONE GENERATOR, ELECTRONIC INSTRUMENT, AND STORAGE MEDIUM

BACKGROUND OF THE INVENTION

1. Field of the Invention

The present invention relates to a tone generator and an electronic instrument for generating a single tone signal by mixing tone component signals obtained by tone generating units, and a storage medium for computer readably storing processing steps for implementing that.

2. Description of the Related Art

Conventionally, for example, an electronic instrument generates a single tone signal corresponding to a key touch from tone component signals such as soft, middle, and loud tone components. For this purpose, a tone generator with the arrangement as shown in FIG. 1 is prevalently used in an electronic instrument.

More specifically, as shown in the above FIG. 1, an electronic instrument has three tone generating units 901 to 903. The first, second, and third tone generating units 901, 902, and 903 respectively read out waveform data 911, 912, and 913, which are stored in a waveform memory (not shown) and respectively serve as soft, middle, and loud tone components, and generate and output soft, middle, and loud tone component signals 921, 922, and 923. That is, the first tone generating unit 901 generates the soft tone component signal 921 corresponding to a soft key touch from the waveform data 911, the second tone generating unit 902 generates the middle tone component signal 922 corresponding to a middle key touch form the waveform data 912, and the third tone generating unit 903 generates the loud tone component signal 923 corresponding to a hard key touch from the waveform data 913. One tone signal for a key touch performing by the player is generated with changing the mixing ratio of the aforementioned soft, middle, and loud tone component signals 921, 922, and 923 in accordance with the intensity of the key touch.

For example, in case of a soft key touch, a tone signal for the key touch is generated and output using only the soft tone component signal 921 generated by the first tone generating unit 901.

On the other hand, in case of a middle key touch, the second tone generating unit 902 generates the middle tone component signal 922, and a tone signal corresponding to the key touch is generated and output by mixing this middle tone component signal 922 and the soft tone component signal 921 generated by the first tone generating unit 901. At this time, as the key touch becomes harder, the mixing ratio of the middle tone component signal 922 of the second tone generating unit 902 increases, and inversely the mixing ratio of the soft tone component signal 921 of the first tone generating unit 901 decreases. Finally, the mixing ratio of the soft tone component signal 921 becomes "0" to leave the middle tone component signal 922 alone. In this manner, a tone ranging from a soft key touch to a middle key touch can smoothly change.

In case of a hard key touch, the third tone generating unit 903 generates the loud tone component signal 923, and a tone signal for the key touch is generated and output by mixing this loud tone component signal 923 and the middle tone component signal 922 generated by the second tone generating unit 902. Also at this time, as the key touch becomes harder, the mixing ratio of the loud tone component signal 923 of the third tone generating unit 903 increases, and inversely the mixing ratio of the middle tone component signal 923 of the second tone generating unit 902 decreases, thereby smoothly changing the tone ranging from a middle key touch to a hard key touch. But, since the loud tone component signal 923 does not contain any soft tone component signal (a signal in the low frequency range), the mixing ratio of the middle tone component signal 922 must not be set at "0". That is, the middle tone component signal 922 must always be output.

However, as described above, in the conventional arrangement for generating a tone signal, individual tone component signals are generated and mixed from units of waveform data as sources for a single tone signal, while changing the mixing ratio at that time in accordance with the key touch intensity, thereby generating a tone signal for the key touch. According to this arrangement, a change in tone color can be implemented in accordance with the player's key touch, but the waveform data of all tone components (soft, middle, and loud tone components, and the like) must be stored in a waveform memory.

Besides, when generating and producing a single tone signal, tone generation channels of a sound source LSI corresponding to the types of tone component signals used for that are required. For example, when one tone signal is generated and produced from three tone component signals, i.e., soft, middle, and loud tone component signals, three tone generation channels are used. For this reason, even when the total number of tone generation channels of the sound source LSI is 48, the number of tones that are actually produced at the same time is 16 (48÷3=16). That is, when a single tone signal is produced, the number of tones that are produced at the same time decreases with increasing the number of tone component signals used for that.

For example, Japanese Patent Laid-Open Nos. 1-257898, 1-269995, and the like, describe an arrangement for generating a single tone signal by obtaining kinds of waveform data by filtering a single unit of waveform data, and synthesizing (mixing) those waveform data. With this arrangement, however, though the waveform memory size can be saved since only the single unit of waveform data as a source for generating a tone signal need only be stored in the waveform memory, the tone generation channels corresponding to the kinds of waveform data (which are actually used to generate a tone signal) obtained by filtering that waveform data are required, and the number of tones that are produced at the same time decreases accordingly.

Therefore, since tone generation channels of the sound source LSI must be used in accordance with the number of tone component signals used to generate a tone signal, conventionally the limited tone generation channels of the sound source LSI cannot effectively be used. Also, when the number of kinds of tone component signals is increased to implement a larger change in tone color, the number of tones that are produced at the same time decreases accordingly, and hence, the number of tone generation channels of the sound source LSI must be increased, thus increasing circuit scale.

SUMMARY OF THE INVENTION

The present invention has been made to remove the aforementioned shortcomings, and aims to provide a tone generator and an electronic instrument that can easily generate natural tones in accordance with key touch intensities by fully utilizing the limited tone generation channels of a sound source, and a storage medium computer-readably storing processing steps for implementing that.

Under such an object, a tone generator of the present invention for generating and producing a tone based on tone information by mixing at least first to third tone component signals, is characterized by comprising waveform storage means for storing a first waveform signal in which the first and second tone components are synthesized, and a second waveform signal consisting of the third tone component; first tone component signal acquisition means for acquiring the first tone component signal by extracting said first tone component from the first waveform signal of said waveform storage means; second tone component signal acquisition means for acquiring the second tone component signal by extracting said second tone component from the first waveform signal of said waveform storage means; control means for executing operation by switching said first tone component signal acquisition means and said second tone component signal acquisition means on the basis of said tone information; and tone signal generation means for generating a tone signal based on said tone information by mixing, by the operation execution control in said control means, the first tone component signal obtained by said first tone component signal acquisition means or the second tone component signal obtained by said second tone component signal acquisition means, and the third tone component signal acquired from the second waveform signal of said waveform storage means.

In another feature of the tone generator of the present invention, said tone information is characterized by including at least one of touch information, pitch information, and tone color information.

In another feature of the tone generator of the present invention, said control means is characterized by switching the operation execution of said first tone component signal acquisition means and said second tone component signal acquisition means on the basis of a comparison result between touch information contained in said tone information, and a threshold value set in advance to said touch information.

In this case, said threshold value may be so constructed as to vary in accordance with pitch information contained in said tone information. Besides, said threshold value may be so constructed as to vary in accordance with tone color information contained in said tone information. Besides, said threshold value may be so constructed as to be able to be arbitrarily set from the outside.

In another feature of the tone generator of the present invention, one component of said first to third tone components is characterized by containing a noise component.

In another feature of the tone generator of the present invention, it is characterized by comprising third tone component signal acquisition means for acquiring a fourth tone component signal in which the first and second tone components are synthesized from the first waveform signal of said waveform storage means.

In another feature of the tone generator of the present invention, said first tone component signal acquisition means is characterized by including a first filter system for cutting said second tone component of said first waveform signal, said second tone component signal acquisition means is characterized by including a filter system for cutting said first tone component of said first waveform signal, and said control means is characterized by switching a filter system to allow said first waveform signal to pass between said first and second filter systems on the basis of said tone information.

In another feature of the tone generator of the present invention, said first tone component signal acquisition means is characterized by including a first filter type program for cutting said second tone component of said first waveform signal, said second tone component signal acquisition means is characterized by including a second filter type program for cutting said first tone component of said first waveform signal, and said control means is characterized by switching a filter type program to be executed between said first and second filter type programs on the basis of said tone information.

An electronic instrument of the present invention for generating and producing a tone based on tone information by mixing at least first to third tone component signals, is characterized by comprising waveform storage means for storing a first waveform signal in which the first and second tone components are synthesized, and a second waveform signal consisting of the third tone component; first tone component signal acquisition means for acquiring the first tone component signal by extracting said first tone component from the first waveform signal of said waveform storage means; second tone component signal acquisition means for acquiring the second tone component signal by extracting said second tone component from the first waveform signal of said waveform storage means; control means for executing operation by switching said first tone component signal acquisition means and said second tone component signal acquisition means on the basis of said tone information; and tone signal generation means for generating a tone signal based on said tone information by mixing, by the operation execution control in said control means, the first tone component signal obtained by said first tone component signal acquisition means or the second tone component signal obtained by said second tone component signal acquisition means, and the third tone component signal acquired from the second waveform signal of said waveform storage means.

A storage medium of the present invention which computer-readably stores processing steps for generating and producing a tone based on tone information by mixing at least first to third tone component signals, is characterized in that said processing steps include the storage step of storing a first waveform signal in which the first and second tone components are synthesized, in a waveform memory together with a second waveform signal consisting of the third tone component; the tone component signal acquisition step of acquiring the first or second tone component signal from said first waveform signal by switching, on the basis of said tone information, an output destination of said first waveform signal of said waveform memory between a first filter system for cutting said second tone component from said first waveform signal, and a second filter system for cutting said first tone component from said second waveform signal; and the tone signal generation step of generating a tone signal based on said tone information by mixing the first or second tone component signal obtained by said tone component signal acquisition step, and the third tone component signal acquired from the second waveform signal of said waveform memory.

A storage medium of the present invention which computer-readably stores processing steps for generating and producing a tone based on tone information by mixing at least first to third tone component signals, is characterized in that said processing steps include the storage step of storing a first waveform signal in which the first and second tone components are synthesized, in a waveform memory together with a second waveform signal consisting of the third tone component; the program storage step of storing a first filter type program for cutting said second tone component from said first waveform signal, and a second filter type program for cutting said first tone component from said second waveform signal, in a program memory; the tone component signal acquisition step of acquiring the first or second tone component signal from said first waveform signal by reading and executing a filter type program to be executed with switching between said first and second filter type programs, on the basis of said tone information; and the tone signal generation step of generating a tone signal based on said tone information by mixing the first or second tone component signal obtained by said tone component signal acquisition step, and the third tone component signal acquired from the second waveform signal of said waveform memory.

In another feature of the storage medium of the present invention, said tone information is characterized by including at least one of touch information, pitch information, and tone color information.

In another feature of the storage medium of the present invention, said tone component signal acquisition step is characterized by including the step of comparing touch information contained in said tone information and a threshold value set in advance to said touch information, and the step of executing said switching on the basis of the comparison result in said step.

In this case, said threshold value may vary in accordance with pitch information contained in said tone information. Besides, said threshold value may vary in accordance with tone color information contained in said tone information. Besides, said threshold value may be able to be arbitrarily set by an operation member on a control panel.

In another feature of the storage medium of the present invention, one component of said first to third tone components is characterized by containing a noise component.

In another feature of the storage medium of the present invention, said tone component signal acquisition step is characterized by including the step of executing said switching including a filter system outputting said first waveform signal intact as a tone component signal, or a filter type program for outputting said first waveform signal intact as a tone component signal.

BRIEF DESCRIPTION OF THE DRAWINGS

FIG. 5 is a view for explaining a filter system designation table used to switch the above filter system;

FIG. 14 is a view for explaining a filter type designation table used to switch the filter type on the basis of key touch information, in the above tone generator;

DETAILED DESCRIPTION OF THE PREFERRED EMBODIMENTS

Hereinafter, the preferred embodiments of the present invention will be described with reference to drawings.

(First Embodiment)

Figure 2:
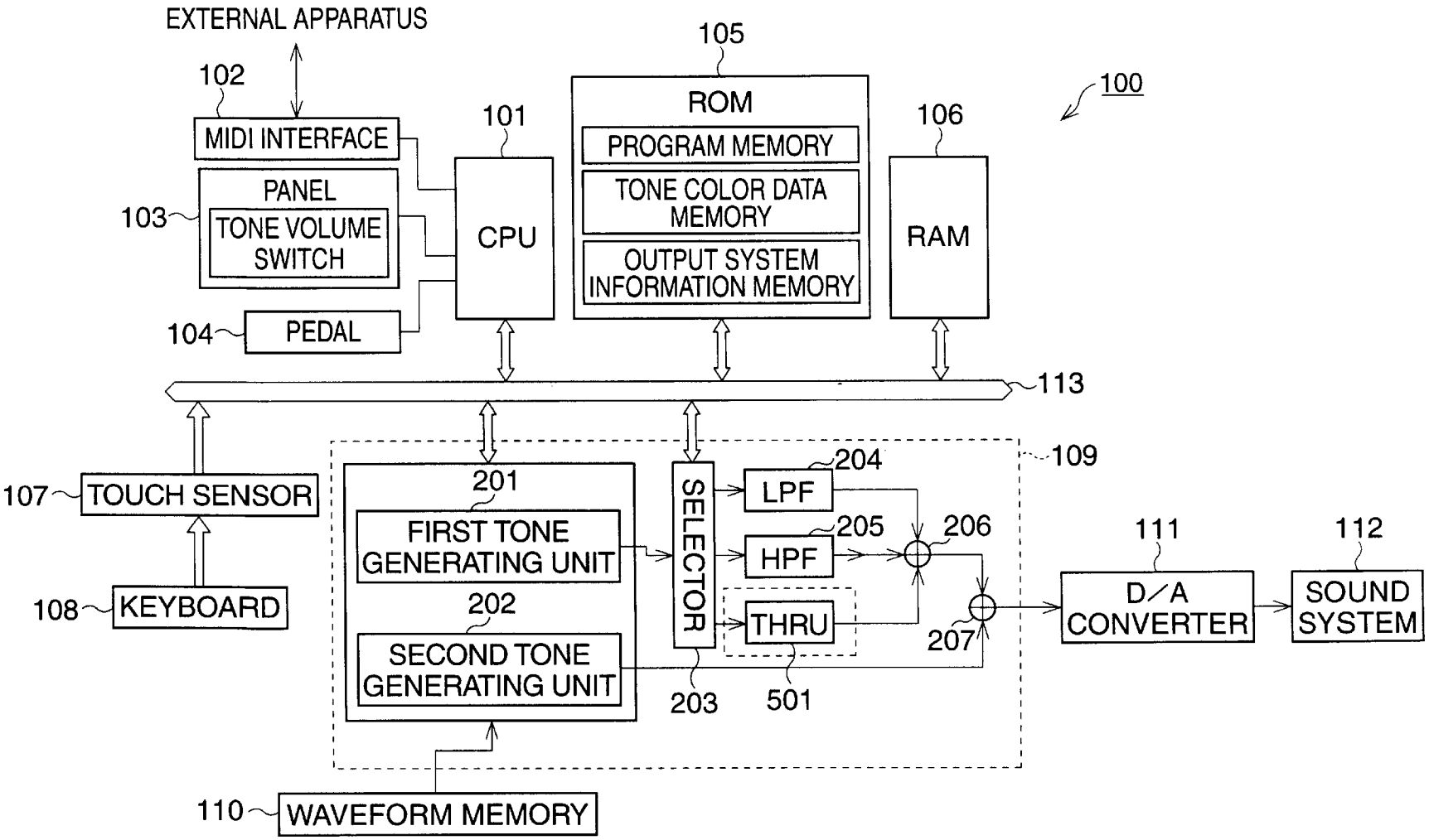
FIG. 2 is a block diagram showing the arrangement of an electronic instrument to which the present invention is applied, in the first embodiment.

The present invention is applied to an electronic instrument 100 as shown in, e.g., FIG. 2.

As shown in the above FIG. 2, this electronic instrument 100 is so constructed that a CPU 101 to which a MIDI interface 102 connected to an external apparatus (not shown), a control panel 103 provided with a tone volume switch and the like, and a pedal 104 are connected, a ROM 105 which includes a program memory, a tone color data memory, an output system information memory, and the like, a RAM 106 which is used as a work memory of the CPU 101 and the like, a touch sensor 107 to which a keyboard 108 is connected, and a tone generator 109 to which a waveform memory 110 is connected, are coupled via a bus 113 and can exchange information with each other.

The CPU 101 takes charge of various operation controls of the overall electronic instrument 100, and implements these operation controls by reading out and executing various processing programs stored in the ROM 105 (program memory). At this time, the RAM 106 is used as a work memory of the CPU 101.

As the operation controls by the CPU 101, there are, for example, execution of an automatic play in accordance with MIDI data supplied via the MIDI interface 102 (an interface for exchanging information between the electronic instrument 100 and an external apparatus according to the MIDI (Musical Instrument Digital Interface) standards as connection standards between an automatic play apparatus and an external apparatus), and tone volume control according to the operation of a tone volume switch on the control panel 103.

The tone generator 109 has an arrangement as a most characteristic feature of this electronic instrument 100, and is so constructed as to generate three types of tone component signals of soft, middle, and loud tone components using two tone generating units of first and second tone generating units 201 and 202.

Figure 3:
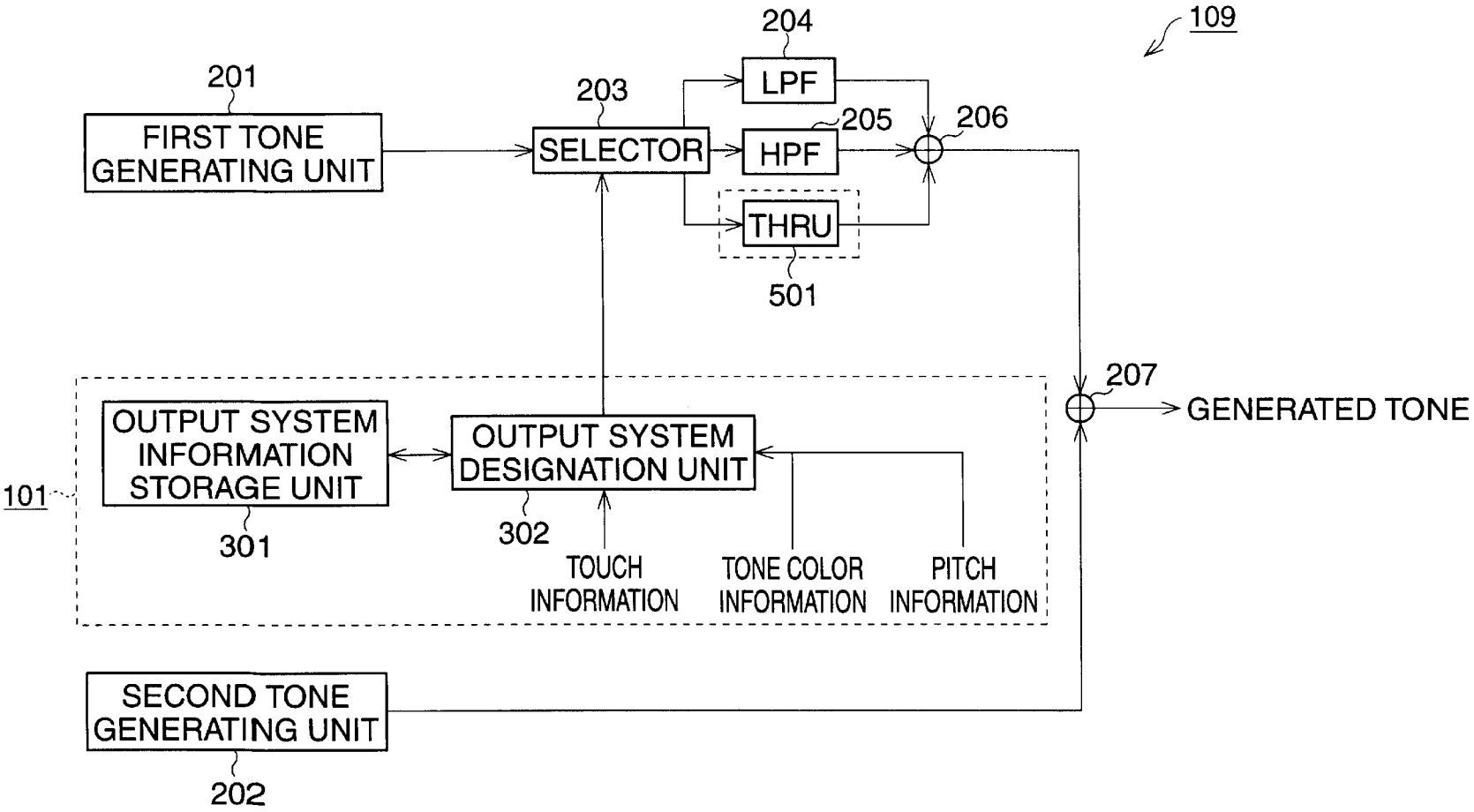
FIG. 3 is a block diagram showing the arrangement of a tone generator of the above electronic instrument.

More specifically, as shown in FIG. 3, the tone generator 109 is so constructed as to include the first tone generating unit 201 for generating and outputting a first tone component signal (a synthesized signal of soft and loud tone components) from waveform data that soft and loud tone components described later are synthesized, the second tone generating unit 202 for generating and outputting a second tone component signal (a signal of middle tone component) from waveform data of a middle tone component, a low-pass filter 204 and a high-pass filter 205 to which the output of the first tone generating unit 201 is supplied, a selector 203 for switching the output destination of the first tone generating unit 201 to the low-pas filter 204 or the high-pass filter 205, an adder 206 for adding filter outputs switched by the selector 203, and an adder 207 for adding the outputs of the adder 206 and the second tone generating unit 202, and outputting as a tone signal.

Therefore, the output of the adder 207 is output from a sound system 112 via a D/A converter 111.

Figure 1:
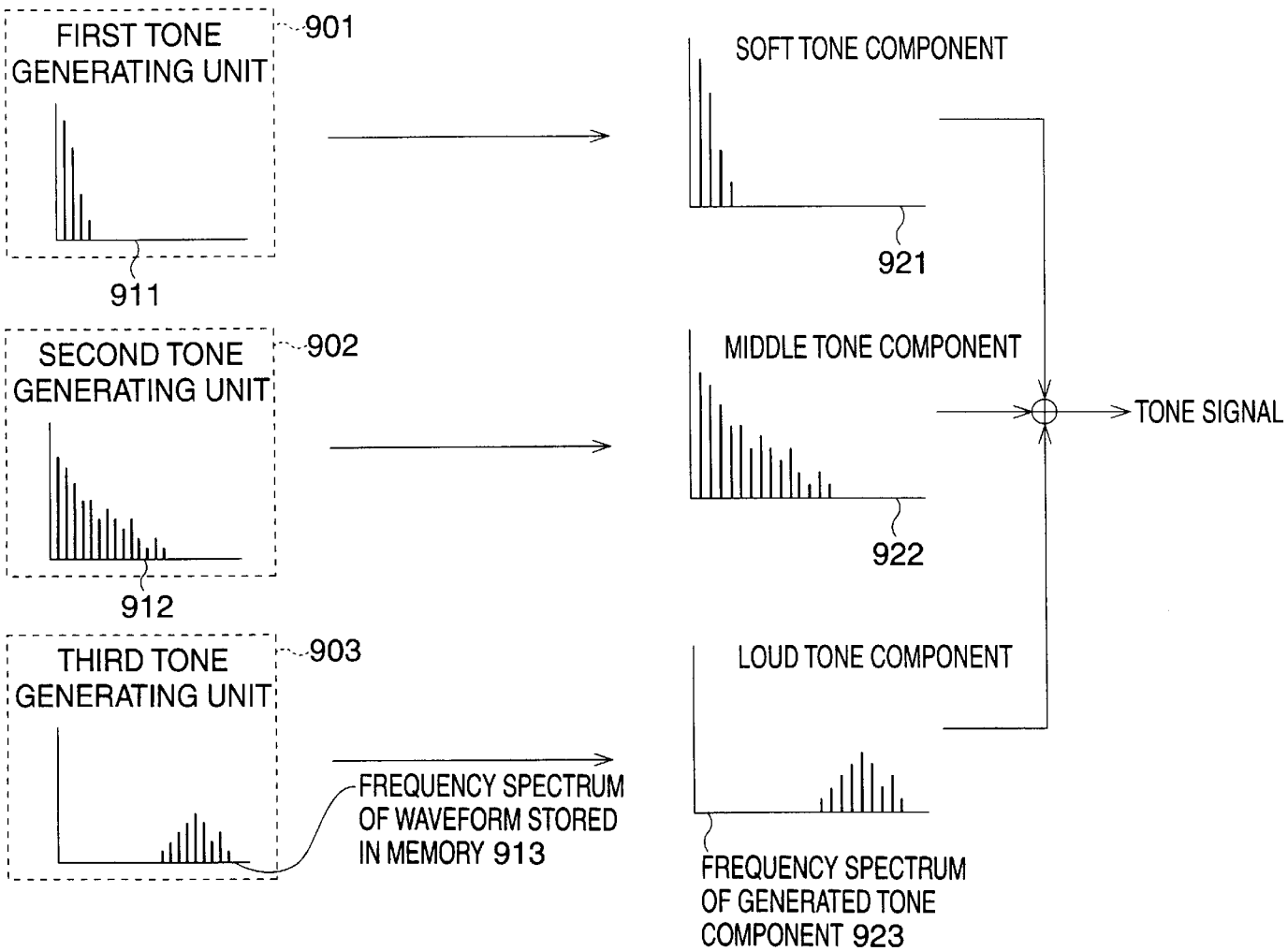
FIG. 1 is a view for explaining the arrangement of a conventional tone generator.

Waveform data used in the first and second tone generating units 201 and 202 are pre-stored in the waveform memory 110 shown in the above FIG. 1. For example, the waveform data 211 that soft and loud tone components are synthesized, and the waveform data 212 of a middle tone component, as shown in FIG. 4, are stored.

Figure 4:
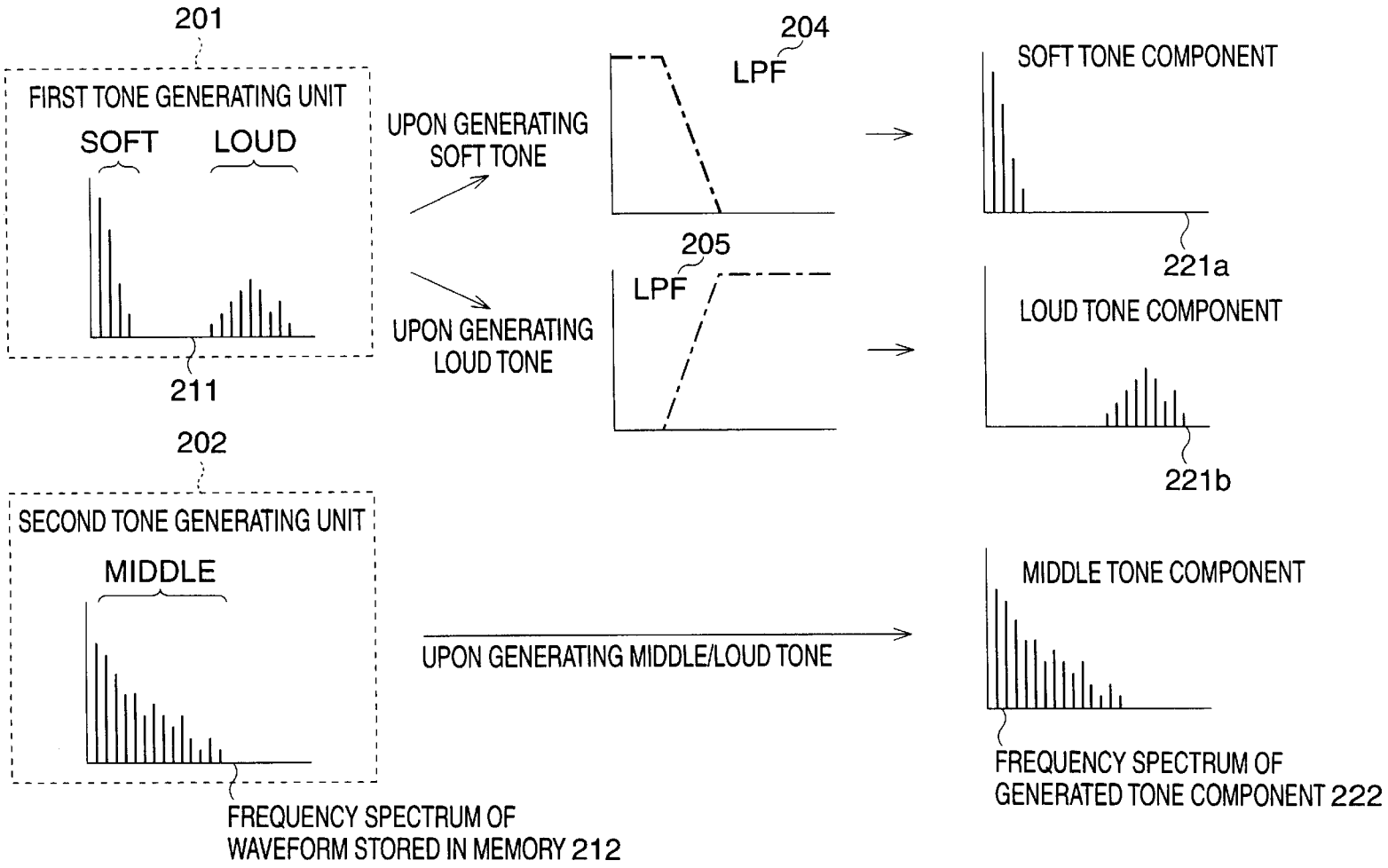
FIG. 4 is a view for explaining the operation for switching the filter system on the basis of key touch information in the above tone generator.
Figure 6:
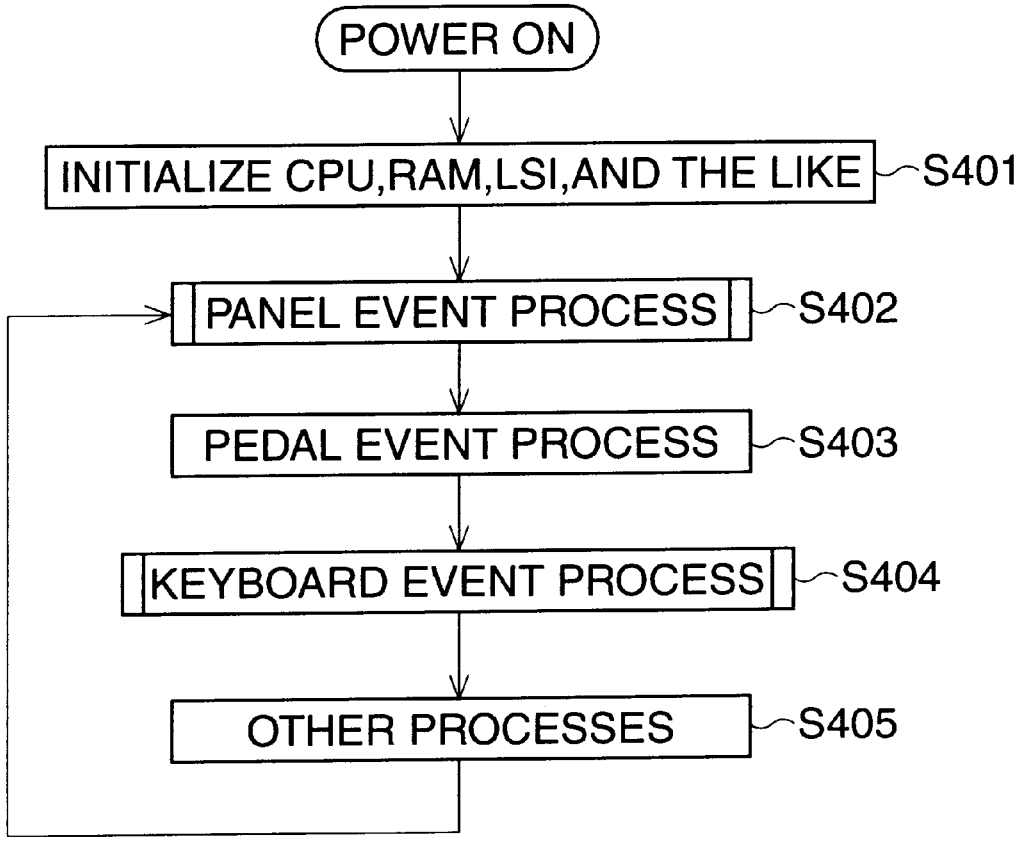
FIG. 6 is a flow chart for explaining a main process executed in the above electronic instrument.
Figure 7:
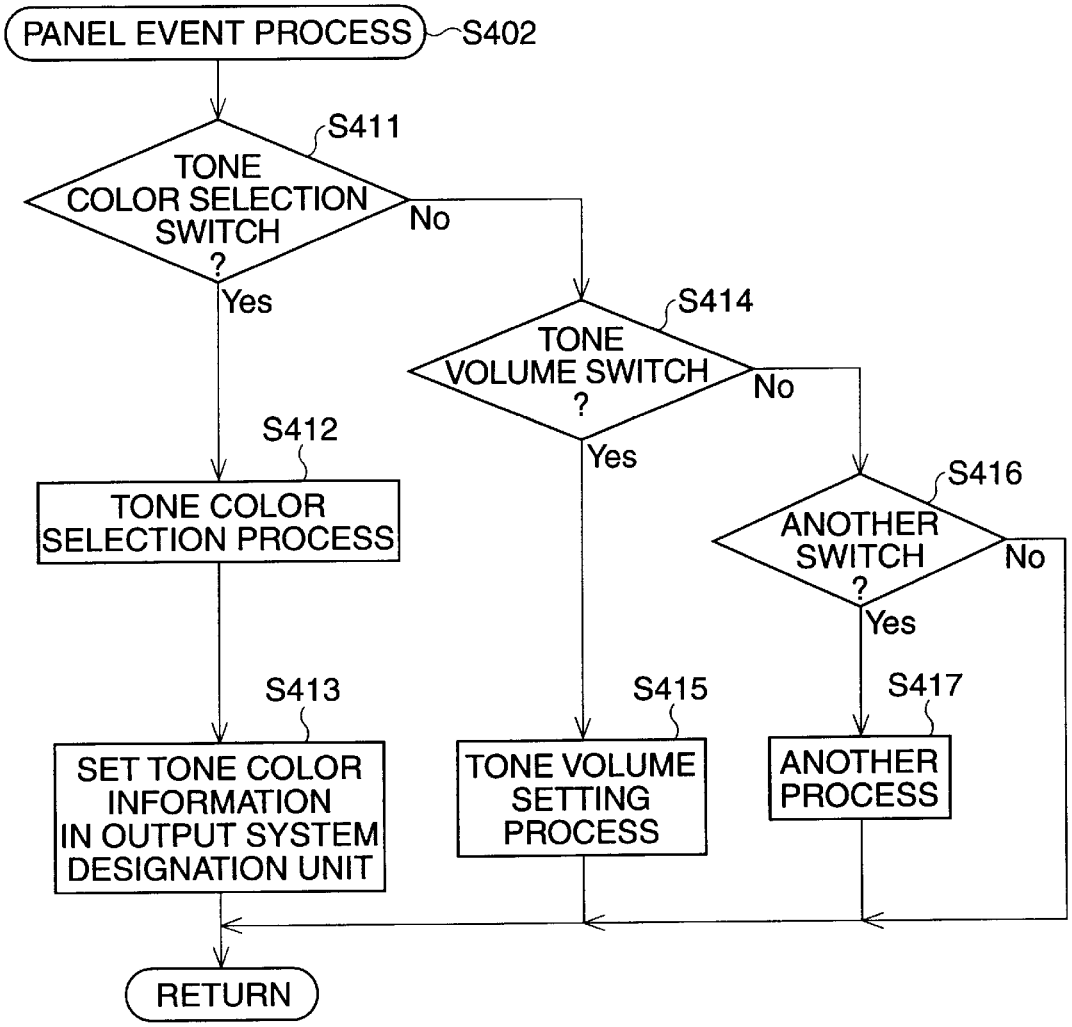
FIG. 7 is a flow chart for explaining a panel event process in the above main process.
Figure 8:
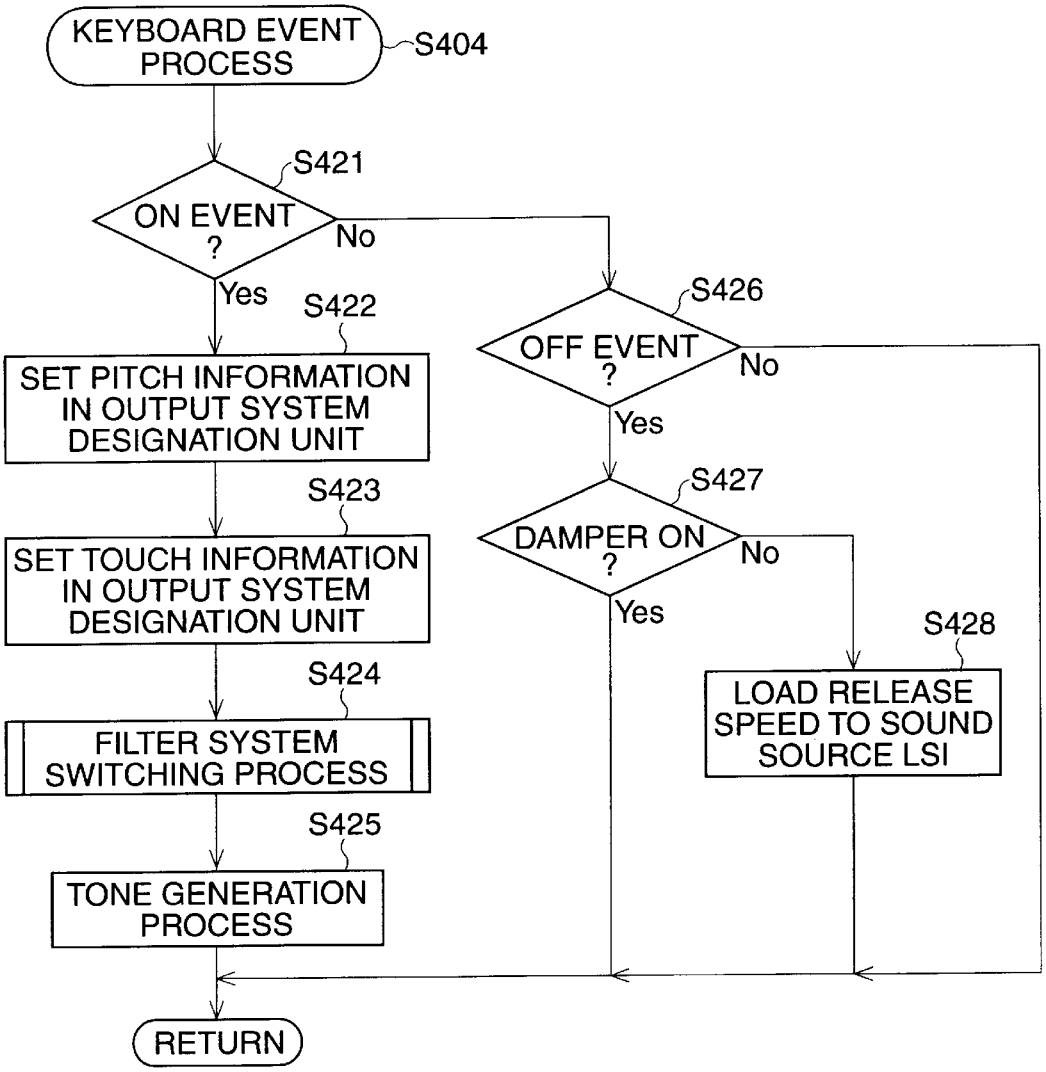
FIG. 8 is a flow chart for explaining a keyboard event process in the above main process.
Figure 9:
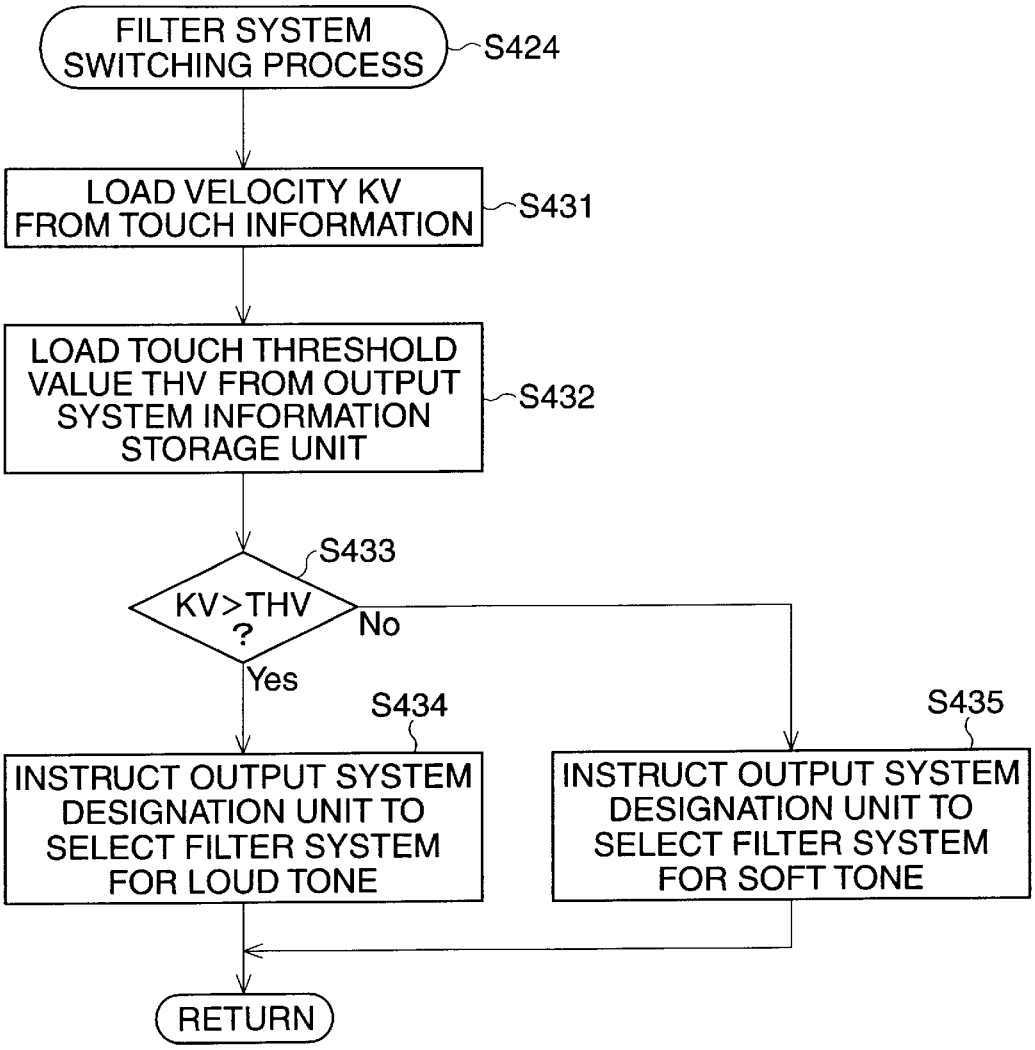
FIG. 9 is a flow chart for explaining a filter system switching process in the above keyboard event process.

In the above FIG. 4, the waveform data 211 and 212 are shown by the frequency spectra of waveform data, and its ordinate represents level, and its abscissa represents frequency.

Assume that the waveform data 211 and 212 pre-stored in the waveform memory 110 are obtained by the following methods.

METHOD EXAMPLE 1

A tone produced by a hardest key touch is recorded, and the waveform of a low-frequency portion (waveform of a soft tone component), the waveform of a portion by broadening the range from that portion (waveform of a middle tone component), and the waveform of a high-frequency portion (waveform of a loud tone component) are taken out by a computer such as a workstation or the like. The waveforms of the soft and loud tone components are synthesized to generate the waveform data 211, which is stored in the waveform memory 110. At this time, in order to allow filters described later to separate easily each component, a gap is provided between the soft and loud tone components. Besides, the waveform of the middle tone component is stored in the waveform memory 110 as the waveform data 212.

METHOD EXAMPLE 2

The actual key touch intensity is changed to soft, middle, and loud, and tones produced by these are recorded. The waveform of the tone recorded by the soft key touch, and the waveform of a high-frequency portion extracted (by the above method example 1 or the like) from the tone recorded by the hard key touch, are synthesized to generate the waveform data 211, which is stored in the waveform memory 110. Also at this time, in order to allow filters described later to separate easily each component, a gap is provided between the soft and loud tone components. Besides, the waveform of the tone recorded by the middle key touch is stored as the waveform data 212 in the waveform memory 110. In this method, especially, since the waveform data 211 and 212 are obtained from the waveforms of the actually produced tones, for example, a tone which has higher reality and closer to a natural tone than that obtained by the arrangement for extracting waveforms of soft, middle, and loud tone components from a single unit of waveform data and generating a tone signal using them can be obtained.

The operation of the aforementioned tone generator 109 is controlled by the CPU 101. For this purpose, the CPU 101 is especially so constructed as to include an output system information storage unit 301 and an output system designation unit 302, as shown in the above FIG. 3.

The output system designation unit 302 judges as to which one of the low-pass filter 204 and the high-pass filter 205 is optimal to use in the tone generator 109, from touch information of an ON key operated at the keyboard 108, pitch (tone range) information of the ON key, tone color information selected by operation at the control panel 103, and output system designation table information pre-stored in the output system information storage unit 301 described later, and supplies the result to the selector 203 of the tone generator 109. The selector 203 switches the output destination of the first tone generating unit 201 to the low-pass filter 204 or the high-pass filter 205 on the basis of the result of the above judgment (to be referred to as "output system designation information" hereinafter) from the output system designation unit 302.

Thereby, as shown in the above FIG. 4, in case of switching to the low-pass filter 204, the output (the synthesized signal of soft and loud tone components) of the first tone generating unit 201 passes through the low-pass filter 204 to cut high-frequency components, thus obtaining a signal 221*a* consisting of only a soft tone component. On the other hand, in case of switching to the high-pass filter 205, the output (the synthesized signal of soft and loud tone components) of the first tone generating unit 201 passes through the high-pass filter 205 to cut low-frequency components, thus obtaining a signal 221*b* consisting of only a loud tone component.

The output system information storage unit 301 pre-stores an output system designation table T1 as shown in, e.g., FIG. 5. This output system designation table T1 is made by setting an address, a threshold value THV of key touch information, filter information (filter system information) FKL to be selected when the velocity of the key touch information of interest is not larger than the threshold value THV, and filter information (filter system information) FKH to be selected when the velocity of the key touch information of interest is larger than the threshold value THV in units of tone colors such as piano (PIANO), guitar (GUITAR), and strings (STRINGS), and in units of pitch ranges such as "0 to 31", "32 to 43", . . .

Therefore, when a tone color of piano is selected at the control panel 103, and the pitch of an ON key at the keyboard 108 falls within the range of "0 to 31", the output system designation unit 302 reads out information (threshold value THV, filter system information FKL, and filter system information FKH) set at address="2000h" corresponding to tone color="PIANO" and pitch="0 to 31" from the output system designation table T1, and thereby judges that the low-pass filter (LPF) 204 indicated by filter system information FKL="1" is to be selected when the velocity of key touch information of the ON key detected by the touch sensor 107 is not larger than "97", or judges that the high-pass filter (HPF) 205 indicated by filter system information FKH="2" is to be selected when the velocity of key touch information of the ON key detected by the touch sensor 107 is larger than "97".

Note that a filter system (THRU) 501 shown by dotted lines in the above FIGS. 2 and 3, and filter system information="0" (THRU) in the output system designation table T1 in the above FIG. 5 will be described later. Here, assume that output of the first tone generating unit 201 passes through one of the low-pass filter 204 and the high-pass filter 205 via the selector 203.

FIGS. 6 to 9 are flow charts showing processing programs executed by the CPU 101 to control the operations of the electronic instrument 100, which include the filter system switching operation in the aforementioned tone generator 109.

Hereinafter, a series of operations of the entire music instrument 100, and especially the filter system switching operation in the tone generator 109 will be described concretely.

[Main Process: Refer to the Above FIG. 6]

First, when the power of the electronic instrument 100 is made ON, the CPU 101, the RAM 106, a sound source LSI (not shown), and the like, are initialized (step S401).

Next, though the detail will be described later, the CPU 101 detects the operation state of the control panel 103, and controls the entire music instrument 100 to operate in accordance with the detection result (step S402).

Next, the CPU 101 detects the operation state of the pedal 104, and controls the entire music instrument 100 to operate in accordance with the detection result (step S403).

Next, though the detail will be described later, it detects the operation state of the keyboard 108 from the output of the touch sensor 107, and controls the entire music instrument 100 to operate in accordance with the detection result (step S404).

The CPU 101 then executes a predetermined process as needed (step S405), and then returns to step S402 to repeat the subsequent step processes.

[Panel Event Process: Step S402: Refer to the Above FIG. 7]

First, the CPU 101 judges as to whether or not a tone color selection switch has been pressed on the control panel 103 (step S411).

If the tone color selection switch has been pressed as a result of the judgment of step S411, the CPU 101 executes a tone color selection process (step S412). For example, it executes a process for setting a flag indicating the selected tone color ON, and turning on an LED provided to a switch (switch on the control panel 103) which indicates the selected tone color.

The CPU 101 then supplies information indicating the selected tone color (tone color information) to the output system designation unit 302 (step S413), and then returns to the main process.

If the tone color selection switch is not pressed as a result of the judgment of step S411, the CPU 101 judges as to whether or not the tone volume switch has been operated on the control panel 103 (step S414).

If the tone volume switch has been operated as a result of this judgment, the CPU 101 executes a tone volume setting process based on the operation (step S415), and then returns to the main process.

If the tone volume switch is not operated as a result of the judgment of step S411, the CPU 101 judges as to whether or not a switch other than the tone color selection switch and the tone volume switch has been operated on the control panel 103 (step S416).

If another switch has been operated as a result of this judgment, the CPU 101 executes a predetermined process based on the operation (step S417), and then returns to the main process.

If no other switch is operated, the CPU 101 returns intact to the main process.

[Keyboard Event Process: Step S404: Refer to the Above FIG. 8]

First, the CPU 101 judges from the output of the touch sensor 107 as to whether or not the keyboard 108 is in an ON event state, i.e., there is an ON key (step S421).

If there is an ON key on the keyboard 108 as a result of the judgment of step S421, the CPU 101 supplies the pitch information and key touch information to the output system designation unit 302 (steps S423 and S424).

Although the detail will be described later, the output system designation unit 302 selects the corresponding filter system (low-pass filter 204 or high-pass filter 205) from the aforementioned output system designation table T1 (refer to the above FIG. 5), and the above pitch information and key touch information, and supplies the selection result (filter system information) to the selector 203. Thereby, the filter system of the output destination of the first tone generating unit 201 is switched (step S424).

The CPU 101 then executes a predetermined process for generating and producing a tone signal from the output of the first tone generating unit 201 which has passed through the low-pass filter 204 or high-pass filter 205, and the output of the second tone generating unit 202 (step S425), and then returns to the main process.

If there is no ON key on the keyboard 108 as a result of the judgment of step S421, the CPU 101 judges as to whether or not the keyboard 108 is in an OFF event state (step S426).

If it is in no OFF event state as a result of this judgment, the CPU 101 returns intact to the main process.

If it is in an OFF event state as a result of the judgment of step S426, the CPU 101 judges as to whether or not the damper pedal is ON (step S427).

If the damper pedal is ON as a result of this judgment, the CPU 101 returns intact to the main process.

On the other hand, if the damper pedal is not ON, the CPU 101 loads the release speed onto the sound source LSI to execute operation control for ending tone generation (step S428), and then returns to the main process.

[Filter Switching Process: Step S424: Refer to the Above FIG. 9]

First, the output system designation unit 302 takes out velocity information KV from the key touch information supplied by the above-described step S424 (step S431).

Next, the output system designation unit 302 reads out a corresponding threshold value THV from the output system designation table T1 (refer to the above FIG. 5) stored in the output system storage unit 301 on the basis of the velocity information KV obtained in step S431 and the tone color information supplied by the above-described step S423 (step S432).

Next, the output system designation unit 302 compares the above velocity information KV and the above threshold value THV (step S433).

If the above velocity information KV is larger than the above threshold value THV as a result of comparison in step S433, the output system designation unit 302 selects a filter system indicated by the value of filter system information FKH, and supplies filter system information indicating that effect to the selector 203 (step S434). After that, it returns to the keyboard event process.

If the above velocity information KV is not larger than the above threshold value THV as a result of comparison in step S433, the output system designation unit 302 selects a filter system indicated by the value of filter system information FKL, and supplies filter system information indicating that effect to the selector 203 (step S435). After that, it returns to the keyboard event process.

By the aforementioned processes, in the tone generator 109, a tone signal corresponding to the key touch on the keyboard 108 is generated as follows (refer to the above FIGS. 3 and 4).

First, in case of a soft key touch, the low-pass filter 204 is selected as a filter system. Thereby, the output of the first tone generating unit 201 (tone component signal based on the waveform data 211 that soft and loud tone components are synthesized) passes through the low-pass filter 204. Hence, from the low-pass filter 204, a signal 221*a* consisting of only a soft tone component is output. At this time, there is no output from the second tone generating unit 202 by the operation control of the CPU 101. In this manner, the soft tone component signal 221*a* output from the first tone generating unit 201 is output from the sound system 112 via the adder 207 and the D/A converter 111 in turn. Therefore, from the sound system 112, a soft tone is output.

Next, in becoming a middle key touch, the second tone generating unit 202 outputs a middle tone component signal 222 based on the waveform data 212 of a middle tone component by the operation control of the CPU 101. Also, since the low-pass filter 204 is selected as a filter system, the soft tone component signal 221*a* is output from the low-pass filter 204. Therefore, the soft and middle tone component signals 221*a* and 222 are supplied to the adder 207, and a signal that the soft and middle tone component signals 221*a* and 222 are added (mixed) is output from the adder 207. At this time, the mixing ratio of the soft and middle tone component signals 221*a* and 222 in the adder 207 is controlled by the CPU 101. That is, control is performed to increase the mixing ratio of the middle tone component signal 222 and to decrease the mixing ratio of the soft tone component signal 221*a* as the key touch intensity increases. Thereby, a tone ranging from a soft key touch to a middle key touch is output from the sound system 112 in accordance with the key touch intensity. When the key touch intensity further increases, the mixing ratio of the soft tone component signal 221*a* finally becomes "0" (signal level="0"). That is, a signal of only the middle tone component signal 222 is output from the adder 207. Therefore, from the sound system 112, a middle tone is output at this time.

When the key touch further increases, the high-pass filter 205 is selected as a filter system. Thereby, the output of the first tone generating unit 201 (tone component signal based on the waveform data 211 that soft and loud tone components are synthesized) passes through the high-pass filter 205. Therefore, from the high-pass filter 205, a signal 221*b* consisting of only a loud tone component is output. At this time, from the second tone generating unit 202, the middle tone component signal 222 is output by the operation control of the CPU 101. Hence, the loud and middle tone component signals 221*b* and 222 are supplied to the adder 207, and a signal that the loud and middle tone component signals 221*b* and 222 are added (mixed) is output from the adder 207.

At this time, the mixing ratio of the loud and middle tone component signals 221*b* and 222 in the adder 207 is controlled by the CPU 101. That is, control is performed to increase the mixing ratio of the loud tone component signal 221*b* and to decrease the mixing ratio of the middle tone component signal 222 as the key touch intensity increases. Thereby, a tone ranging from a middle key touch to a hard key touch is output from the sound system 112 in accordance with the key touch intensity. But, in this case, since the loud tone component signal 221 does not contain any soft tone component signal, the mixing ratio of the middle tone component signal 222 is controlled not to become "0". That is, the middle tone component signal 222 is controlled to be always output.

As described above, in this embodiment, by switching the low-pass filter 204 and the high-pass filter 205 on the basis of the key touch intensity, it is so constructed that two kinds of tone component signals of soft and loud tone component signals, can be obtained from a single tone component signal (a signal that soft and loud tone components are synthesized) output from the first tone generating unit 201.

Thereby, conventionally, in case of using three kinds of tone component signals (signals of soft, middle, and loud tone components) for generating a single tone signal, three waveform data and three tone generating units must be independently prepared. However, according to this embodiment, since two waveform data of the waveform data 211 that soft and loud tone components are synthesized, and the waveform data 212 of a middle tone component, and the two tone generating units of the first and second tone generating units 201 and 202 need only be provided, the waveform memory can be effectively used, and the circuit scale can be reduced, thus achieving a cost reduction of the overall instrument.

Besides, as for the number of tones that are produced at the same time, conventionally, even in the arrangement described in Japanese Patent Laid-Open Nos. 1-257898, 1-269995, and the like, tone generation channels corresponding to the number of kinds of tone component signals must be used. However, according to this embodiment, since it is so constructed that two kinds of tone component signals (soft and loud tone component signals) can be generated by a single tone generating unit (first tone generating unit 201) that generates a signal that soft and loud tone components are synthesized, the number of tone generation channels used can be decreased accordingly. For example, when a single tone signal is generated from three tone component signals of soft, middle, and loud tone components, while three tone generation channels corresponding to the respective tone component signals are required, in this embodiment, two tone generation channels of a tone generation channel for a signal that soft and loud tone components are synthesized, and a tone generation channel for a middle tone component signal are sufficient.

Therefore, according to this embodiment, a larger change in tone color can be implemented by fully utilizing the limited tone generation channels of the sound source LSI.

Besides, by being so constructed that switching the filter system is also changeable by the pitch and tone color, an optimal filter system can be selected, thus providing a more natural and better tone color.

(Second Embodiment)

For example, mainly in a piano tone color, there is a component which is not expressed by harmonic overtones in addition to harmonic overtone components such as the soft, middle, and loud tone component signals 221*a*, 221*b*, and 222 as shown in the above FIG. 4, i.e., a noise component such as striking noise (impact noise).

Figure 10:
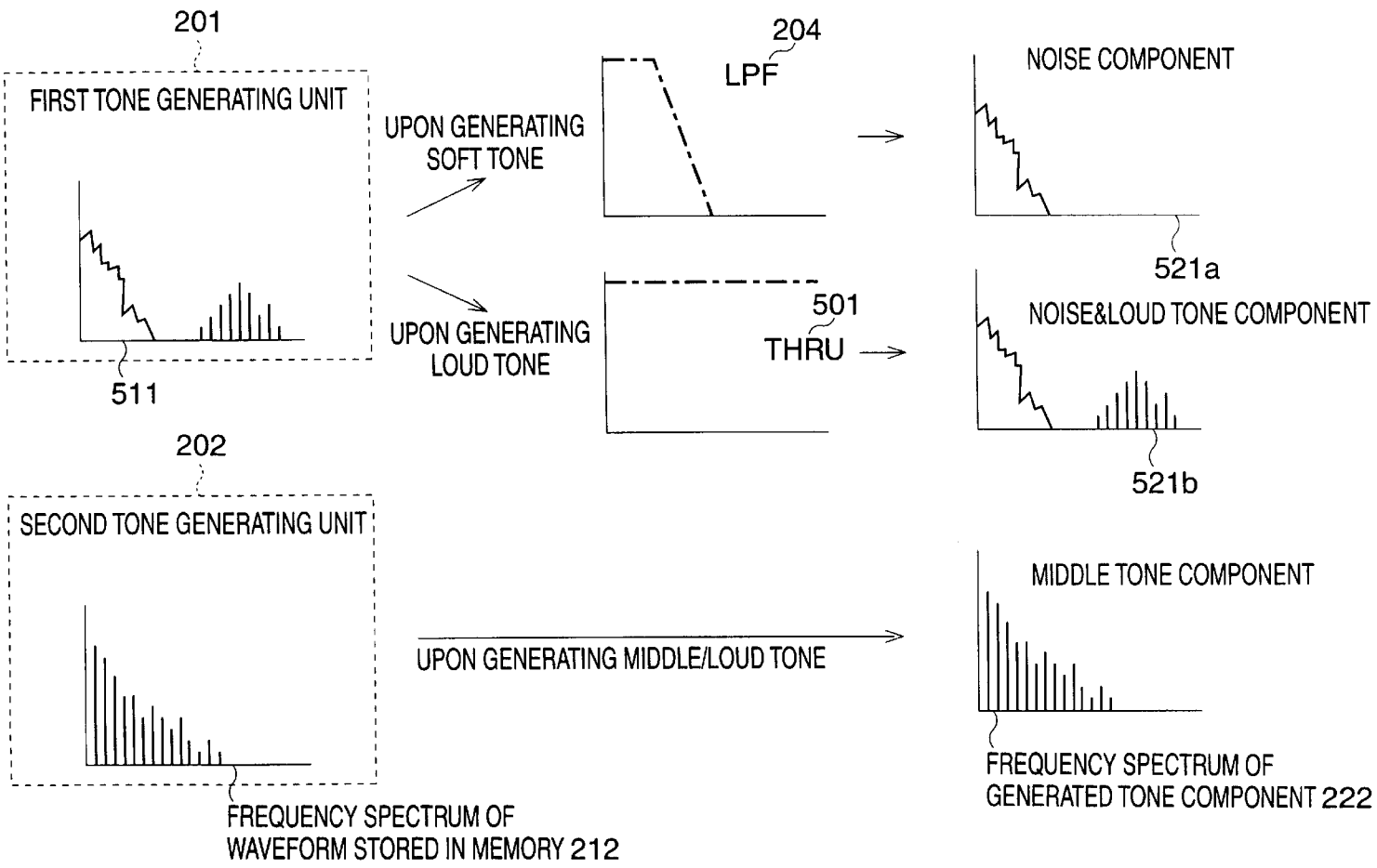
FIG. 10 is a view for explaining the operation for switching the filter system on the basis of the above key touch information, in the second embodiment.

So, in this embodiment, in the electronic instrument 100 of the first embodiment described above, the first tone generating unit 201 generates and outputs a tone component signal that a noise component and a loud tone component are synthesized, as shown in, e.g., FIG. 10.

More specifically, in the electronic instrument 100 shown in the above FIG. 2, the waveform memory 110 pre-stores waveform data 511 that a noise component and a loud tone component are synthesized, as shown in the above FIG. 10.

Assume that this waveform data 511 is obtained by recording a tone containing an actual noise component (a tone containing noise and harmonic overtone components). Alternatively, although a piano produces a tone by the damper moving upward and a string vibrating when striking a key, it is obtained by the manner that the key is struck in a state that the string does not vibrate, the tone produced thereby (a tone containing a noise component alone) is recorded to obtain only the noise component, and it and the loud tone component are synthesized.

Note that, as the waveform data 511 here, for example, the waveform of an actually recorded tone can be used intact, or the waveform of only a noise component that a soft tone component is extracted from the waveform of an actually recorded tone by a workstation or the like.

Besides, as indicated by the dotted line portions in the above FIGS. 2 and 3, the tone generator 109 of the electronic instrument 100 here is provided with a through filter system (THRU) 501 in which the output of the first tone generating unit 201 (a tone component signal that noise and loud tone components are synthesized) is given intact to the adder 206 via neither the low-pass filter 204 nor the high-pass filter 205. This switching is also performed by the aforementioned selector 203.

Furthermore, because the noise component is more noticeable as the tone range (pitch) is higher, in the output system designation table T1 shown in the above FIG. 5, the value of filter system information FKH for a piano tone color is set at "0" (to select the THRU 501 as a filter system) in the high pitch range, and is set at "2" (to select the high-pass filter 205 as a filter system) in the low pitch range. With such setups, when the pitch of the ON key (pitch of a key touch) falls within the high pitch range, a tone signal that a noise component is included in a loud tone component is generated, and a tone near the actual condition can be generated.

Note that combinations of values "0", "1", and "2" to be set as filter system information FKL and FKH in the output system designation table T1 shown in the above FIG. 5 are not limited to those here. Here, since mainly a piano tone color contains a noise component, "0" (THRU) is set as the value of filter system information for the piano tone color. However, when it is wanted not to include any noise component, combinations of "1" and "2" may be set as the values of filter system information. Likewise, other tone colors (guitar, strings, and the like) can be arbitrarily set, and an optimal combination can be set in accordance with the situation at that time. Thereby, a tone color with higher reality, and a tone color that changes desirably can be generated. Such filter system information values can be arbitrarily set also in the first embodiment described above.

With the above arrangement, the tone generator 109 generates a tone signal corresponding to key touch at the keyboard 108 as follows (refer to the above FIGS. 3 and 10).

First, in case of a soft key touch, the low-pass filter 204 is selected as a filter system. Thereby, the output of the first tone generating unit 201 (a tone component signal based on the waveform data 511 that noise and loud tone components are synthesized) passes through the low-pass filter 204. Hence, from the low-pass filter 204, a signal 521*a* consisting of only a noise component by cutting a loud tone component is output. At this time, from the second tone generating unit 202, a middle tone component signal 222 based on the waveform data 212 of a middle tone component is output by the operation control of the CPU 101. Although these tone component signals 521*a* and 222 are mixed by the adder 207, the mixing ratio of the middle tone component signal 222 at this time is controlled by the CPU 101 to decrease. Hence, from the sound system 112, a soft tone containing a noise component is output.

Next, in becoming a middle key touch, by the CPU 101, the mixing ratio of the middle tone component signal 222 in the adder 207 is controlled to increase as the key touch intensity increases. Thereby, a tone ranging from a soft key touch to a middle key touch and containing a noise component is output from the sound system 112 in accordance with the key touch intensity.

When the key touch further increases, the THRU 501 is selected as a filter system. Thereby, the output of the first tone generating unit 201 (a tone component signal based on the waveform data 511 that noise and loud tone components are synthesized) passes through the THRU 501 as it is. To the adder 207, a tone component signal 521*b* based on the waveform data 511 that noise and loud tone components are synthesized, and the middle tone component signal 222 output from the second tone generating unit 202 are supplied, and these tone component signals 521*b* and 222 are mixed. Also at this time, by the CPU 101, the mixing ratios of the respective tone component signals 521*b* and 222 in the adder 207 are controlled. That is, control is performed to increase the mixing ratio of the tone component signal 521 (noise and loud tone components) and to decrease the mixing ratio of the middle tone component signal 222 as the key touch intensity becomes higher. Thereby, a tone ranging from a middle key touch to a hard key touch and containing a noise component is output from the sound system 112 in accordance with the key touch intensity. But, in this case, since the tone component (noise and loud tone components) signal 521*b* does not contain any soft tone component signal, the mixing ratio of the middle tone component signal 222 is controlled not to become "0". That is, the middle tone component signal 222 is controlled to be always output.

As described above, in this embodiment, the THRU filter system 501 is provided together with the low-pass filter 204 and the high-pass filter 205 as the filter system to be switched, and two kinds of tone component signals of a noise component signal and a loud tone component signal containing a noise component can be obtained from a single tone component signal (a signal that noise and loud tone components are synthesized) output from the first tone generating unit 201.

Thereby, in addition to the effects of the first embodiment mentioned above, a tone color (a tone containing a noise component) like a piano especially can be naturally produced with higher reality.

Also, since addition or the like of a noise component can be freely changed in accordance with the values set as filter system information FKL and FKH in the output system designation table T1 in the above FIG. 5, variations of tone colors to be generated can be increased.

(Third Embodiment)

Figure 11:
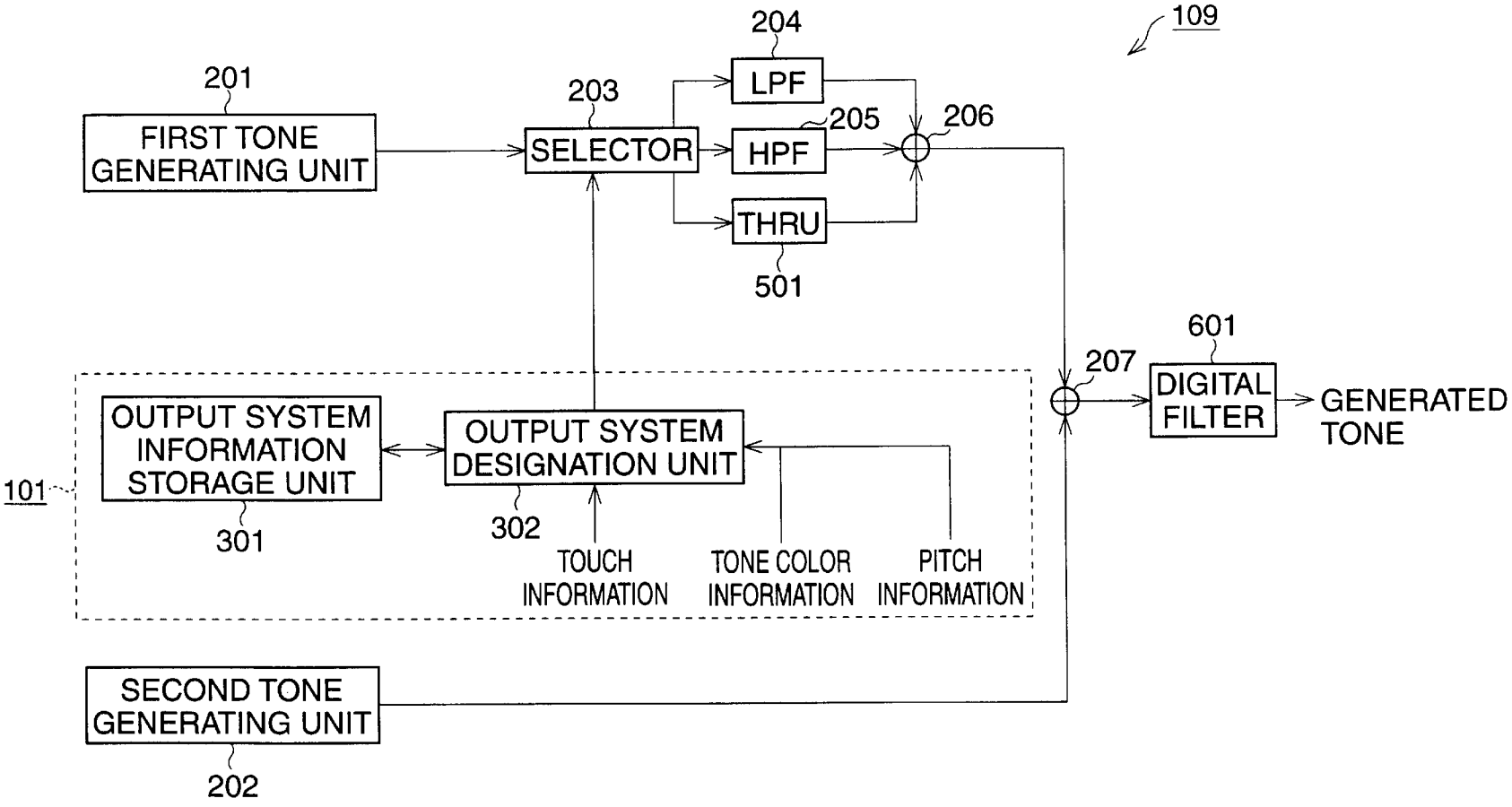
FIG. 11 is a block diagram showing the arrangement of a tone generator of the above electronic instrument, in the third embodiment.

In this embodiment, in the electronic instrument 100 in the first and second embodiments mentioned above, it is so constructed that the output (tone signal) of the adder 207 is given to the D/A converter 111 of the above FIG. 2 via a digital filter 601, as shown in, e.g., FIG. 11.

Thereby, to a tone to be generated, more minute tone color control can be done, and a smoother tone can be generated. That is, changes in level among soft, middle, and loud tone components that form a tone can be smooth. This is particularly effective for a case wherein a tone to which a noise component is added is generated as the aforementioned second embodiment.

In the aforementioned first and second embodiments, if the waveform data (waveform data pre-stored in the waveform memory 110) used by the first and second tone generating units 201 and 202 are generated by recording actually produced tones (soft, middle, and loud tones, and the like) as described above, a tone in a considerably good state (real, natural tone) can be produced even not in the arrangement with the digital filter 601 like the third embodiment. However, in the arrangement with the digital filter 601, a tone in a better state can be produced.

Besides, in the first to third embodiments described above, processes in the filter systems are digital processes. However, they are not limited to these. For example, analog filters may be used as filter systems, and after analog-converting the output of the first tone generating unit 201, it is so constructed to be through an analog filter selected by the selector 203.

(Fourth Embodiment)

In this embodiment, in the electronic instrument 100 in the aforementioned first to third embodiments, the arrangement for generating a tone signal from tone component signals obtained by switching the filter systems as a most characteristic feature is implemented by software.

Note that a case will be described here wherein the above arrangement of the first embodiment is implemented by software for the sake of simplicity. Besides, in the drawings used in the following description of this embodiment, the parts having the same constructions as the first to third embodiments are denoted by the same reference numerals, and a detailed description thereof will be omitted.

Figure 12:
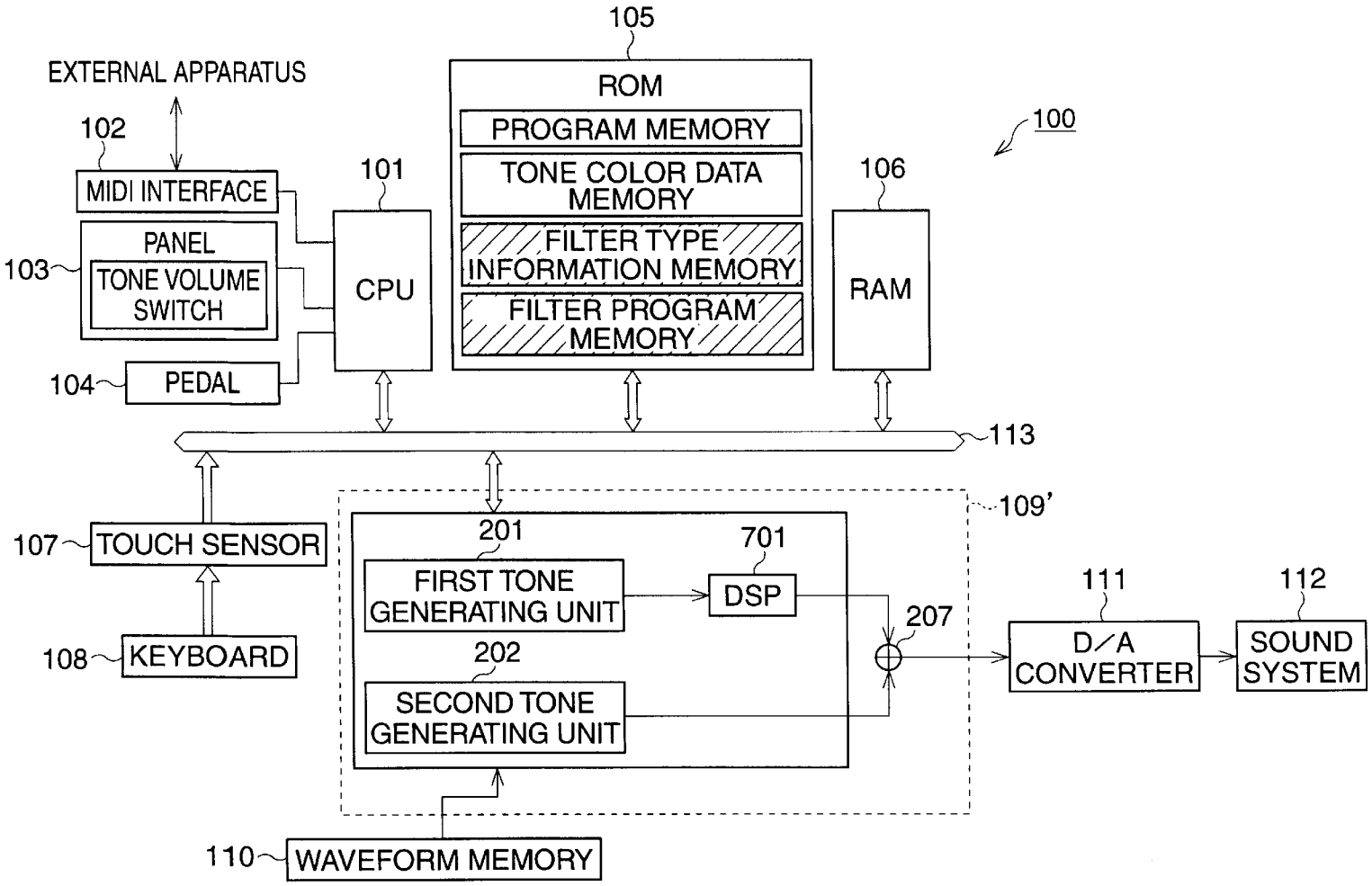
FIG. 12 is a block diagram showing the arrangement of an electronic instrument, in the fourth embodiment.

For this reason, the electronic instrument 100 here has an arrangement as shown in, e.g., FIG. 12. That is, the electronic instrument 100 of the above FIG. 12 has the same arrangement as the electronic instrument 100 of the first embodiment (refer to the above FIG. 2), but differs in the arrangement of a tone generator 109' corresponding to the tone generator 109.

The tone generator 109' comprises a DSP (Digital Signal Processor) 701 to which the output of the first tone generating unit 201 (here, a tone component signal that soft and loud tone components are synthesized) is supplied, and the output of the DSP 701 is supplied to the adder 207.

The DSP 701 implements a filter process to the output of the first tone generating unit 201 by executing a predetermined filter type program described later, and supplies this to the adder 207.

Figure 13:
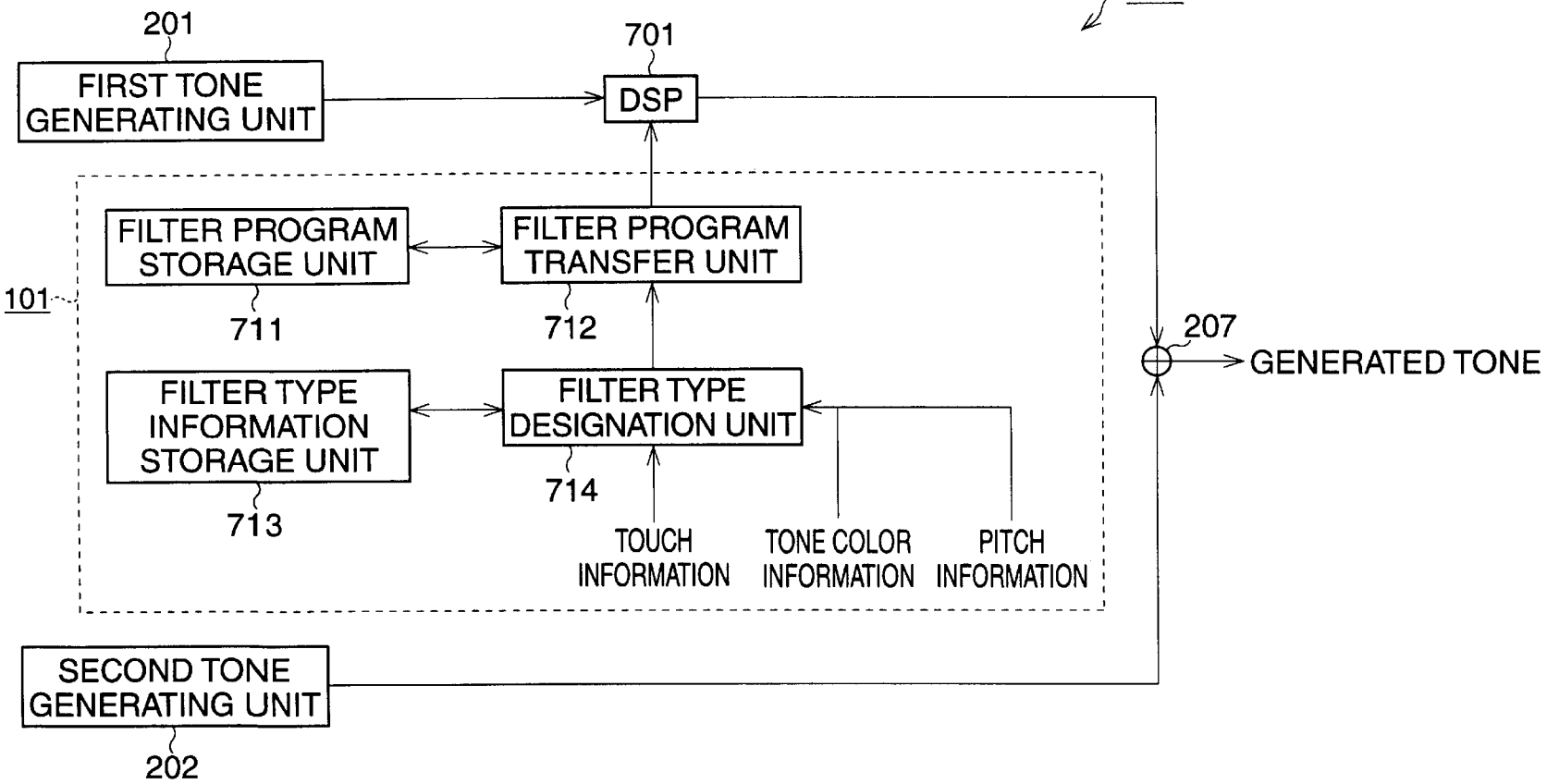
FIG. 13 is a block diagram showing the arrangement of a tone generator of the above electronic instrument.

Besides, the CPU 101 is so constructed as to include a filter program storage unit 711, a filter program transfer unit 712, a filter type information storage unit 713, and a filter type designation unit 714, as shown in, e.g., FIG. 13, so as to control the operation of the aforementioned tone generator 109'.

The filter type designation unit 714 judges as to which filter type (here, high-pass filter type or low-pass filter type) program is to be transferred to the DSP 701 by the filter program transfer unit 712 described later, from touch information of an ON key operated on the keyboard 107 and pitch (tone range) information of the ON key, and tone color information selected by operation at the control panel 103, and output system designation table information pre-stored in the filter type information storage unit 713 described later, as in the output system designation unit 302 (refer to the above FIG. 3), and supplies the result to the filter program transfer unit 712.

In the filter type information storage unit 713, a filter type designation table T2 as shown in FIG. 14 is stored. This filter type designation table T2 has the same configuration as the output system designation table T1 shown in the above FIG. 5. But, note that "FTL" and "FTH" in the drawing represent filter type program information (filter type information) to be selected when the velocity of the key touch information of interest is not larger than the threshold value THV, and filter type program information (filter type information) to be selected when the velocity of the key touch information of interest is larger than the threshold value THV.

The filter program transfer unit 712 reads out a corresponding filter type program from the filter program storage unit 711 on the basis of the above judgment result from the filter type designation unit 714 (hereinafter, to be referred to as "filter type designation information"), and transfers it to the DSP 701. Thereby, the filter type program executed by the DSP 701 is switched in accordance with key touch information.

In the filter program storage unit 711, various filter type programs such as high-pass filter type, low-pass filter type, and the like, are stored.

Note that the filter type designation table T2 stored in the filter type information storage unit 713 and various filter type programs stored in the filter program storage unit 711 are pre-stored in a filter information memory and filter program memory (refer to the above FIG. 12) included in the ROM 105.

Figure 15:
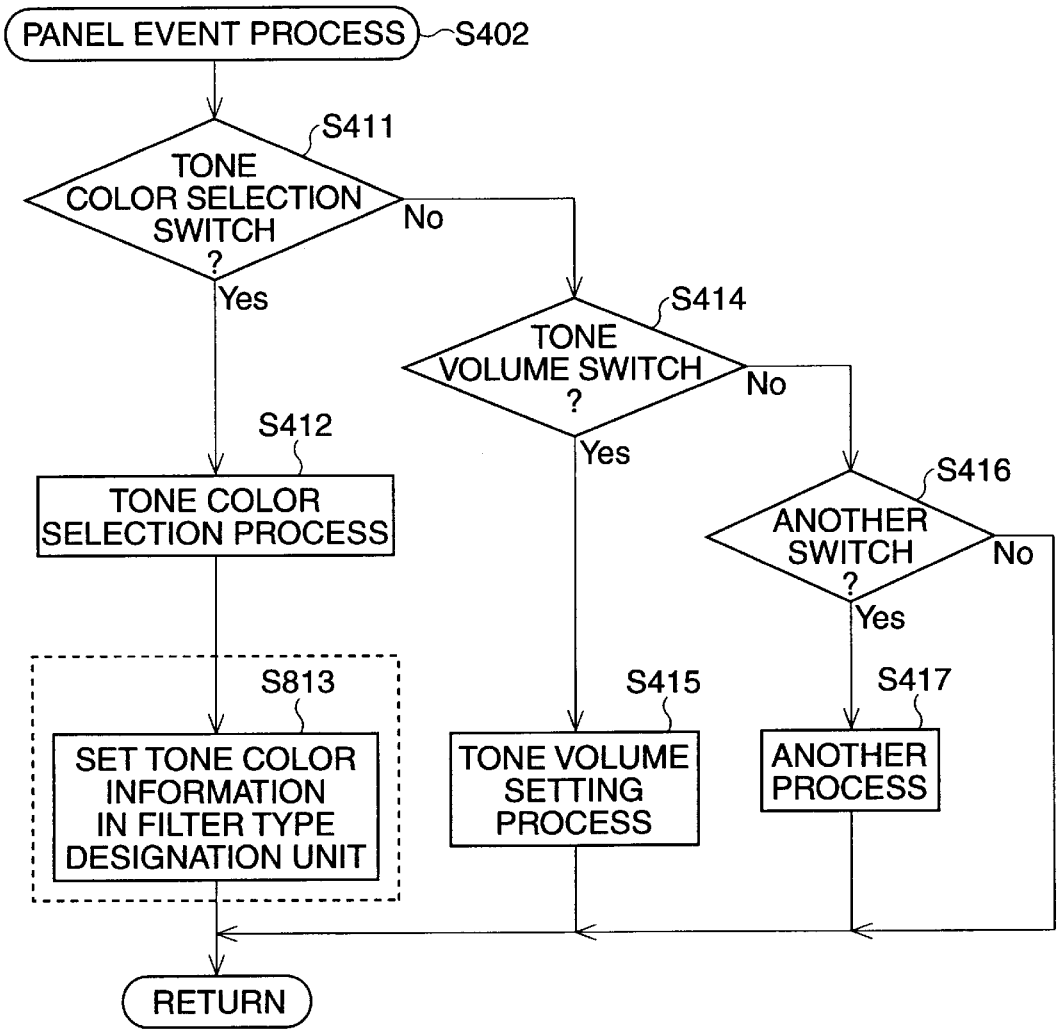
FIG. 15 is a flow chart for explaining a panel event process in the above main process.
Figure 16:
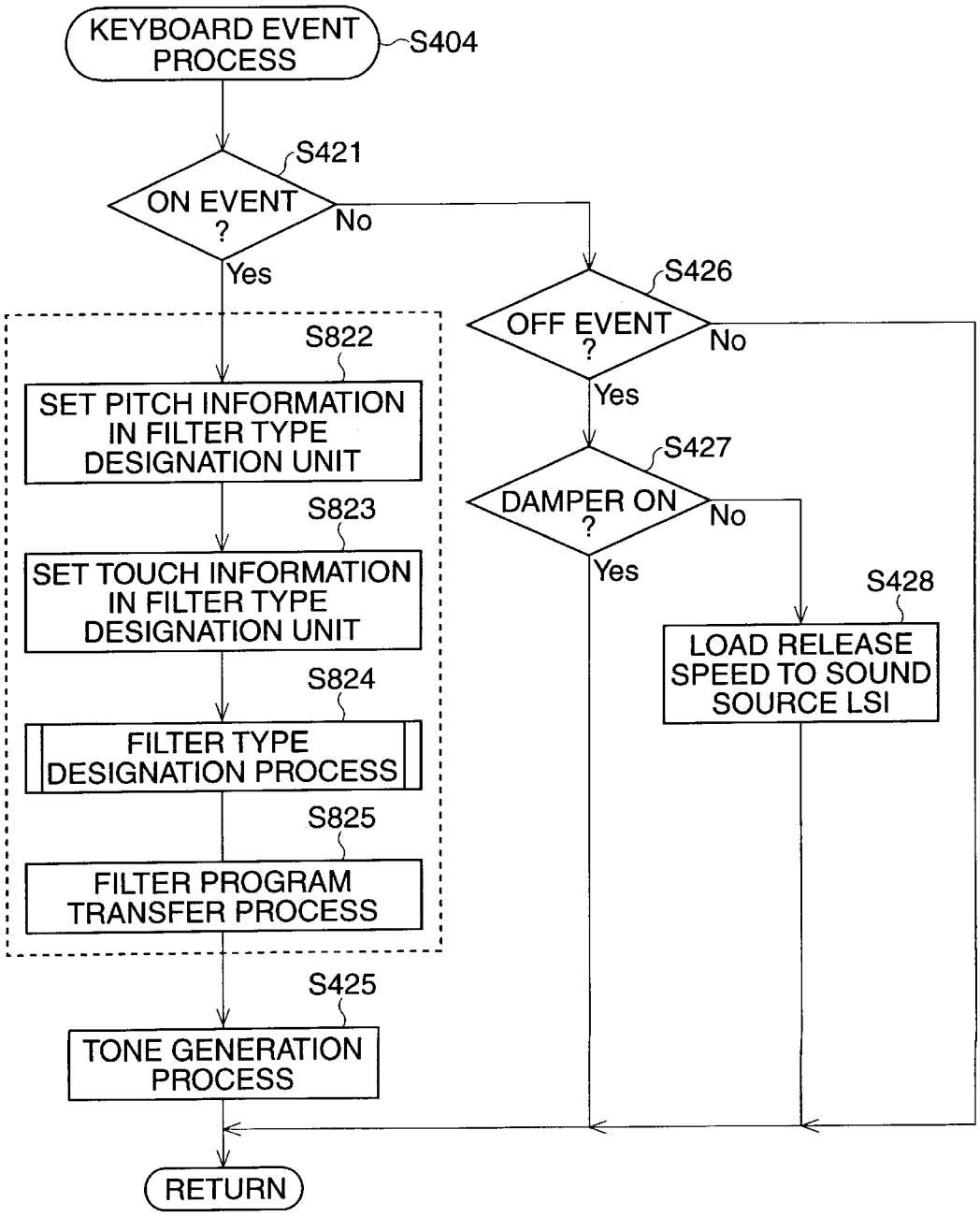
FIG. 16 is a flow chart for explaining a keyboard event process in the above main process.
Figure 17:
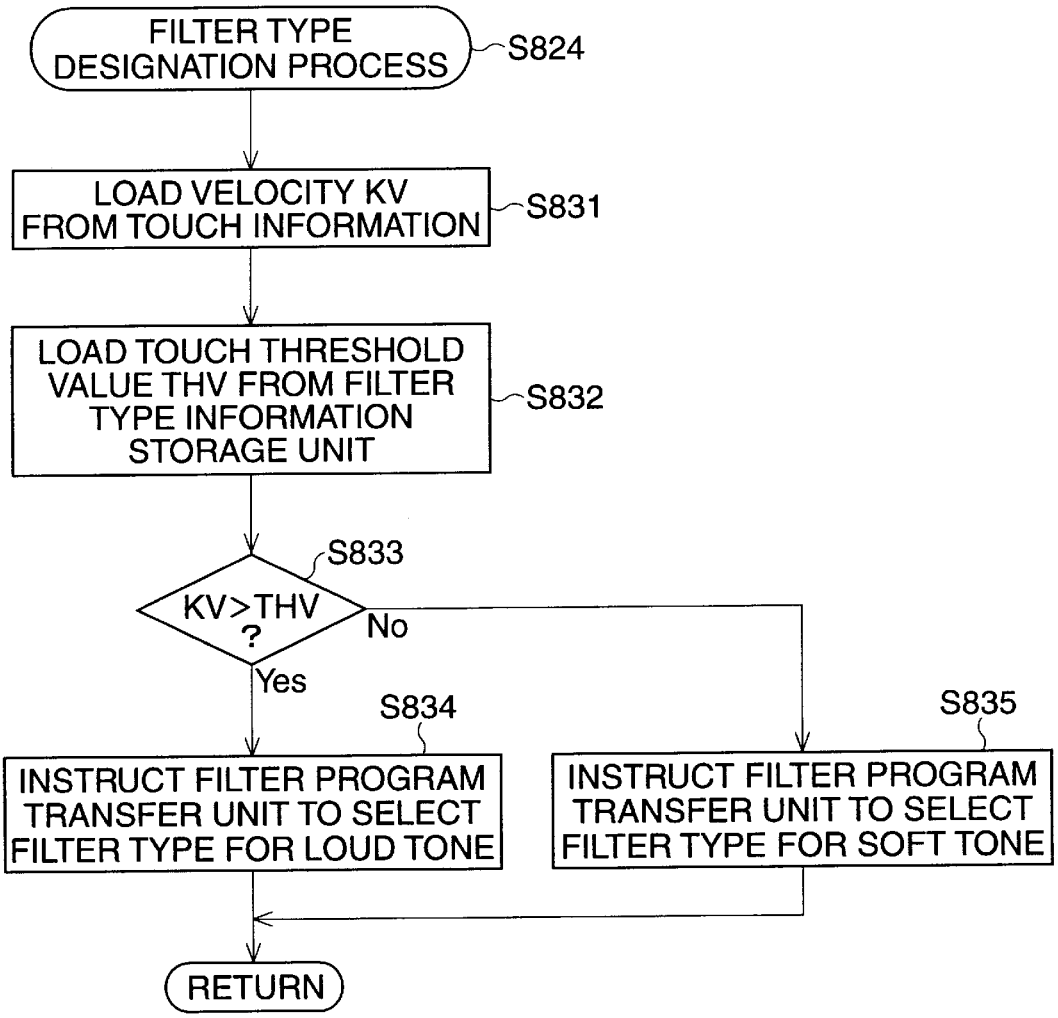
FIG. 17 is a flow chart for explaining a filter type switching process in the above keyboard event process.

FIGS. 15 to 17 show, by flow charts, processing programs executed by the CPU 101 to control the operations of the electronic instrument 100 that include the aforementioned filter type switching operation in the tone generator 109'.

Hereinafter, a series of operations of the entire electronic instrument 100, and especially the filter type switching operation in the tone generator 109', will be described concretely.

[Main Process: Refer to the Above FIG. 6]

As has been explained in the first embodiment, first, when the power of the electronic instrument 100 is made ON, the CPU 101, the RAM 106, the sound source LSI, and the like are initialized (step S401), and the CPU 101 repetitively executes a panel event process (step S402), a pedal event process (step S403), a keyboard event process (step S404), and other predetermined processes (step S405) in turn.

[Panel Event Process: Step S402: Refer to the Above FIG. 15]

First, the CPU 101 judges as to whether or not a tone color selection switch has been pressed on the control panel 103 (step S411).

If the tone color selection switch has been pressed as a result of this judgment, the CPU 101 executes a tone color selection process (step S412).

The CPU 101 then supplies information indicating the selected tone color (tone color information) to the filter type designation unit 714 (step S813), and then returns to the main process.

If the tone color selection switch is not pressed as a result of the judgment of step S411, the CPU 101 judges as to whether or not the tone volume switch has been operated on the control panel 103 (step S414). If the tone volume switch has been operated, it executes a tone volume setting process (step S415), and then returns to the main process. On the other hand, if the tone volume switch is not operated, the CPU 101 judges as to whether or not another switch has been operated (step S416). If another switch has been operated, it executes a predetermined process based on the operation (step S417), and then returns to the main process. If no other switch is operated, the CPU 101 returns intact to the main process.

[Keyboard Event Process: Step S404: Refer to the Above FIG. 16]

First, the CPU 101 judges by the output of the touch sensor 107 as to whether or not the keyboard 108 is in an ON event state, i.e., there is an ON key (step S421).

If there is an ON key on the keyboard 108 as a result of the judgment of step S421, the CPU 101 supplies its pitch information and key touch information to the filter type designation unit 714 (steps S822 and S823).

Although the detail will be described later, the filter type designation unit 714 selects the corresponding filter type (here, low-pass filter type or high-pass filter type) from the aforementioned filter type designation table T2 (refer to the above FIG. 14), and the above pitch information and key touch information, and supplies the selection result (filter type information) to the filter program transfer unit 712 (step S824).

The filter program transfer unit 712 reads out the corresponding filter type program from the filter program storage unit 711 on the basis of filter type information from the filter type designation unit 714, and transfers this to the DSP 701. Thereby, the filter type program to be executed by the DSP 701 is switched (step S825).

The CPU 101 then executes a predetermined process for generating and producing a tone signal from the output of the first tone generating unit 201 (the output of the first tone generating unit 201, which has undergone the filter process by the above filter type program) via the DSP 701, and the output from the second tone generating unit 202 (step S425), and then returns to the main process.

If there is no ON key on the keyboard 108 as a result of the judgment of step S421, the CPU 101 judges as to whether or not the keyboard 108 is in an OFF event state (step S426). If not in an OFF event state, it returns intact to the main process. On the other hand, if in an OFF event state, the CPU 101 judges as to whether or not the damper pedal is ON (step S427). If the damper pedal is ON, it returns intact to the main process. If the damper pedal is not ON, it executes operation control for ending tone generation (a process for loading the release speed onto the sound source LSI, or the like) (step S428), and then returns to the main process.

[Filter Type Designation Process: Step S824: Refer to the Above FIG. 17]

First, the filter type designation unit 714 takes out velocity information KV from the key touch information supplied by the above step S823 (step S831).

Next, the filter type designation unit 714 reads out a corresponding threshold value THV from the filter type designation table T2 (refer to the above FIG. 14) stored in the filter type information storage unit 713 on the basis of the velocity information KV obtained in step S831 and the tone color information supplied by the above-described step S822 (step S832).

Next, the filter type designation unit 714 compares the above velocity information KV and the above threshold value THV (step S833).

If the above velocity information KV is larger than the above threshold value THV as a result of comparison in step S833, the filter type designation unit 714 selects a filter type indicated by the value of filter type information FTH, and supplies filter type information indicating that effect to the filter program transfer unit 712 (step S834). After that, it returns to the keyboard event process.

If the above velocity information KV is not larger than the above threshold value THV as a result of comparison in step S833, the filter type designation unit 714 selects a filter type indicated by the value of filter type information FKL, and supplies filter type information indicating that effect to the filter program transfer unit 712 (step S835). After that, it returns to the keyboard event process.

With the aforementioned processes, in the tone generator 109', the same result as has been explained using the above FIG. 4 in the first embodiment can be obtained.

That is (refer to the above FIG. 13), in case of a soft key touch, low-pass filter type is selected as a filter type program to be executed by the DSP 701. Thereby, the output of the first tone generating unit 201 (tone component signal based on the waveform data 211 that soft and loud tone components are synthesized) becomes an output consisting of only a soft tone component by cutting a loud tone component. At this time, there is no output from the second tone generating unit 202 by the operation control of the CPU 101. In this manner, a soft tone component signal 221*a* output from the first tone generating unit 201 is output from the sound system 112 via the adder 207 and the D/A converter 111 in turn. Therefore, from the sound system 112, a soft tone is output.

In becoming a middle key touch, the second tone generating unit 202 outputs a middle tone component signal 222 based on the waveform data 212 of a middle tone component by the operation control of the CPU 101. Also, since low-pass filter type is selected as a filter type program to be executed by the DSP 701, to the adder 207, the soft and middle tone component signals 221*a* and 222 are supplied, and a signal that the soft and middle tone component signals 221*a* and 222 are added (mixed) is supplied from the adder 207. At this time, by the CPU 101, control is performed to increase the mixing ratio of the middle tone component signal 222 and to decrease the mixing ratio of the soft tone component signal 221*a* as the key touch intensity increases. Thereby, a tone ranging from a soft key touch to a middle key touch is output from the sound system 112 in accordance with the key touch intensity. Finally, a signal of only the middle tone component signal 222 is output from the adder 207, and at this time, from the sound system 112, a middle tone is output.

When the key touch further increases, high-pass filter type is selected as a filter type program to be executed by the DSP 701. Thereby, the output of the first tone generating unit 201 (tone component signal based on the waveform data 211 that soft and loud tone components are synthesized) becomes an output consisting of only a loud tone component by cutting a soft tone component. At this time, from the second tone generating unit 202, the middle tone component signal 222 is output by the operation control of the CPU 101. Hence, to the adder 207, the loud and middle tone component signals 221*b* and 222 are supplied, and a signal that the loud and middle tone component signals 221*b* and 222 are added (mixed) is output from the adder 207. At this time, by the CPU 101, control is performed to increase the mixing ratio of the loud tone component signal 221*b* and to decrease the mixing ratio of the middle tone component signal 222 as the key touch intensity increases. Thereby, a tone ranging from a middle key touch to a hard key touch is output from the sound system 112 in accordance with the key touch intensity. But, in this case, the middle tone component signal 222 is controlled to be always output.

As described above, in this embodiment, the DSP 701 is provided to the output destination of the first tone generating unit 201, and a filter process for the output of the first tone generating unit 201 is executed by the DSP 701. At this time, a filter type program executed for the above filter process in the DSP 701 is switched on the basis of the key touch intensity.

Thereby, an arrangement in the first embodiment that can obtain two kinds of tone component signals of soft and loud tone component signals from a single tone component signal (a signal that soft and loud tone components are synthesized) output from the first tone generating unit 201 can be implemented by software, and the same effects as the effects in the first embodiment can be obtained, and the following effects can also be obtained.

For example, even in the same low-pass filter for cutting a high-frequency component of the output of the first tone generating unit 201, by preparing patterns of low-pass filter programs wherein cutoff frequencies are changed in accordance with the tone ranges, a more optimal filter pattern can be selected. In this case, in the filter type designation table T2 shown in the above FIG. 14, values more minutely corresponding to the above low-pass filter types are provided as information ("1" or "2" as "FTL" or "FTH" value) indicating the filter type to be selected. More specifically, in a value "1" (=low-pass filter type) of filter type information FTL, values 1, 2, 3, . . . indicating filter types different in cutoff are provided. Thereby, the filter type can be switched more minutely on the basis of key touch information, and more minute tone control can be implemented.

Figure 18:
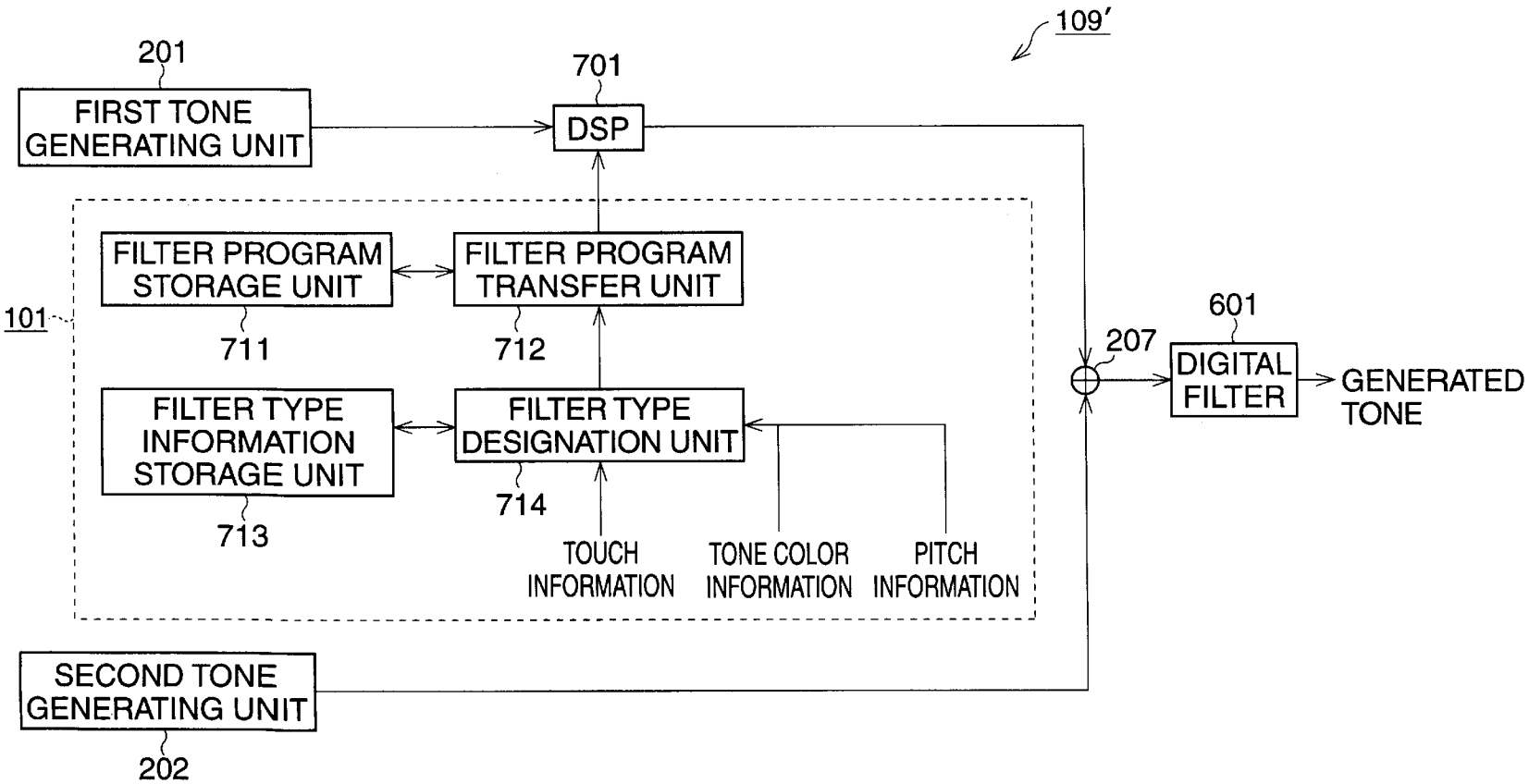
FIG. 18 is a block diagram showing the arrangement in which a digital filter is provided to the above tone generator.

In the fourth embodiment described above, the output (tone signal) of the adder 207 may be given to the D/A converter 111 of the above FIG. 1 via the digital filter 601, as shown in FIG. 18, as in the third embodiment.

Besides, as in the second embodiment described above, the first tone generating unit 201 may generate and output a tone component signal that noise and loud tone components are synthesized.

Also, various values (threshold values THV and the like) to be set in the output system designation table T1 of the above FIG. 5, and the filter type designation table T2 of the above FIG. 14 may be able to be arbitrarily set by operation on, e.g., the control panel 103.

Besides, it is needless to say that the objects of the present invention are also achieved by supplying a storage medium that stores a program code of software that can implement the functions of the host and terminal of the above-mentioned embodiments, to the system or apparatus, and reading out and executing the program code stored in the storage medium by a computer (or a CPU or MPU) of the system or apparatus. In this case, the program code itself read out from the storage medium implements the functions of the embodiments, and the storage medium which stores the program code constitutes the present invention.

As the storage medium for supplying the program code, usable are a ROM, a floppy disk, a hard disk, an optical disk, an optical magnetic disk, a CD-ROM, a CD-R, a magnetic tape, a nonvolatile memory card, and the like.

Besides, it is needless to say that cases that not only the functions of the embodiments are implemented by executing the readout program code by the computer but also part or all of actual processes are executed by an OS or the like running on the computer on the basis of an instruction of the program code and the functions of the embodiments are implemented by the processes are also included.

Furthermore, it is needless to say that the case that, after the program code read out from the storage medium is written in a memory provided in an extension function board inserted in an computer or a function extension unit connected to the computer, on the basis of an instruction of the program code, a CPU or the like provided in the extension function board or the function extension unit executes part or all of actual processes and the functions of this embodiment are implemented by the processes is also included.

As described above, in the present invention, it is so constructed that two kinds of tone component signals of first and second tone component signals can be obtained from a first waveform signal (a signal that first and second tone components are synthesized) on the basis of tone information (touch information and pitch information of an ON key operation, tone color information by panel operation, information contained in a MIDI signal, or the like).

More specifically, for example, a filter system that allows the first waveform signal to pass is switched between a first filter system (digital or analog low-pass filter) for cutting the second tone component (loud tone component), and a second filter system (digital or analog high-pass filter) for cutting the first tone component (soft tone component) (hardware arrangement) on the basis of the intensity of key touch. Or, a filter type program that is loaded and executed to cut a predetermined tone component is switched between a first filter type program for cutting the second tone component (loud tone component), and a second filter type program for cutting the first tone component (soft tone component) (software arrangement). The tone component signal (soft or loud tone component signal) by the first waveform signal obtained by such switching, and a tone component signal (middle component signal) by a second waveform signal are mixed to generate and produce a tone signal in accordance with an ON key operation.

Thereby, conventionally, in case of using first to third tone component signals (soft, middle, and loud tone component signals, and the like) for generating a single tone signal, three waveform signals must be prepared individually. However, according to the present invention, because two waveform signals of the first waveform signal that the first and second tone components are synthesized, and the second waveform signal of a third tone component need only be prepared, the waveform memory can be effectively used, and the circuit scale can be reduced, and thereby a cost reduction of the overall instrument can be intended.

Besides, also as for the number of tones that are produced at the same time, because two kinds of tone component signals of the first and second tone component signals can be generated from the first waveform signal that the first and second tone components are synthesized, the number of tone generation channels used can be decreased accordingly. For example, when a single tone signal is generated from three tone component signals of soft, middle, and loud tone components, while three tone generation channels corresponding to the respective tone component signals are conventionally required, in the present invention, two tone generation channels of a tone generation channel for a signal that soft and loud tone components are synthesized, and a tone generation channel for a middle tone component signal are sufficient. Therefore, a larger change in tone color can be implemented by fully utilizing the limited tone generation channels of the sound source LSI.

Besides, if the key touch threshold value as a reference for switching the filter system or filter type program is variable also in accordance with the pitch or tone color, because an optimal filter system or filter type program can be selected, a more natural and better tone color can be provided. In particular, if it is the software arrangement that switches the filter type program, by providing filter type programs more minutely, and also the above threshold values minutely so as to correspond to them, more minutely switching the filter types can be performed and more minute tone control can be performed.

Also, if it is so constructed that a filter system for outputting the first waveform signal as it is (or a filter type program therefor) is further provided, and either of the first and second tone components is a noise component, two kinds of tone component signals of a noise component signal and a tone component signal containing a noise component can be obtained from the first waveform signal on the basis of information on ON key operation. This and a third tone component signal based on the second waveform signal are mixed to produce a tone signal generated. Thereby, a tone color (a tone containing a noise component) especially like a piano or the like can be naturally produced with higher reality. Besides, also as for other tone colors, by freely changing addition or the like of a noise component, variations of tone colors generated can be increased.

Therefore, according to the present invention, a more natural tone can be easily generated in accordance with the key touch intensity by fully utilizing the limited tone generation channels of the sound source LSI.

What is claimed is:

1. A tone generatore for generating and producing a tone base on tone information by mixing at least first to third tone component signals, characterized by comprising:

waveform storage means for storing a first waveform signal in which the first and second tone components are synthesized, and a second waveform signal consisting of the third tone component;

first tone component signal acquisition means for acquiring the first tone component signal by extracting said first tone component from the first waveform signal of said waveform storage means;

second tone component signal acquisition means for acquiring the second tone component signal by extracting said second tone component from the first waveform signal of said waveform storage means;

control means for executing operation by switching said first tone component signal acquisition means and said second tone component signal acquisition means on the basis of said tone information; and tone signal generation means for generating a tone signal based on said tone information by mixing, by the operation execution control in said control means, the first tone component signal obtained by said first tone component signal acquisition means or the second tone component signal obtained by said second tone component signal acquisition means, and the third tone component signal acquired from the second waveform signal of said waveform storage means.

2. A tone generator described in claim 1, characterized in that said tone information includes at least one of touch information, pitch information, and tone color information.

3. A tone generator described in claim 1, characterized in that said control means switches the operation execution of said first tone component signal acquisition means and said second tone component signal acquisition means on the basis of a comparison result between touch information contained in said tone information, and a threshold value set in advance to said touch information.

4. A tone generator described in claim 3, characterized in that said threshold value varies in accordance with pitch information contained in said tone information.

5. A tone generator described in claim 3, characterized in that said threshold value varies in accordance with tone color information contained in said tone information.

6. A tone generator described in claim 3, characterized in that said threshold value can be arbitrarily set from the outside.

7. A tone generator described in claim 1, characterized in that one component of said first to third tone components contains a noise component.

8. A tone generator described in claim 1, characterized by comprising third tone component signal acquisition means for acquiring a fourth tone component signal in which the first and second tone components are synthesized from the first waveform signal of said waveform storage means.

9. A tone generator described in claim 1, characterized in that said first tone component signal acquisition means includes a first filter system for cutting said second tone component of said first waveform signal, said second tone component signal acquisition means includes a filter system for cutting said first tone component of said first waveform signal, and said control means switches a filter system to allow said first waveform signal to pass between said first and second filter systems on the basis of said tone information.

10. A tone generator described in claim 1, characterized in that said first tone component signal acquisition means includes a first filter type program for cutting said second tone component of said first waveform signal, said second tone component signal acquisition means includes a second filter type program for cutting said first tone component of said first waveform signal, and said control means switches a filter type program to be executed between said first and second filter type programs on the basis of said tone information.

11. An electronic instrument for generating and producing a tone based on tone information by mixing at least first to third tone component signals, characterized by comprising:

waveform storage means for storing a first waveform signal in which the first and second tone components are synthesized, and a second waveform signal consisting of the third tone component;

first tone component signal acquisition means for acquiring the first tone component signal by extracting said first tone component from the first waveform signal of said waveform storage means;

second tone component signal acquisition means for acquiring the second tone component signal by extracting said second tone component from the first waveform signal of said waveform storage means;

control means for executing operation by switching said first tone component signal acquisition means and said second tone component signal acquisition means on the basis of said tone information; and tone signal generation means for generating a tone signal based on said tone information by mixing, by the operation execution control in said control means, the first tone component signal obtained by said first tone component signal acquisition means or the second tone component signal obtained by said second tone component signal acquisition means, and the third tone component signal acquired from the second waveform signal of said waveform storage means.

12. A storage medium which computer-readably stores processing steps for generating and producing a tone based on tone information by mixing at least first to third tone component signals, characterized in that said processing steps include:

the storage step of storing a first waveform signal in which the first and second tone components are synthesized, in a waveform memory together with a second waveform signal consisting of the third tone component;

the tone component signal acquisition step of acquiring the first or second tone component signal from said first waveform signal by switching, on the basis of said tone information, an output destination of said first waveform signal of said waveform memory between a first filter system for cutting said second tone component from said first waveform signal, and a second filter system for cutting said first tone component from said second waveform signal; and the tone signal generation step of generating a tone signal based on said tone information by mixing the first or second tone component signal obtained by said tone component signal acquisition step, and the third tone component signal acquired from the second waveform signal of said waveform memory.

13. A storage medium described in claim 12, characterized in that said tone information includes at least one of touch information, pitch information, and tone color information.

14. A storage medium described in claim 12, characterized in that said tone component signal acquisition step includes the step of comparing touch information contained in said tone information and a threshold value set in advance to said touch information, and the step of executing said switching on the basis of the comparison result in said step.

15. A storage medium described in claim 14, characterized in that said threshold value varies in accordance with pitch information contained in said tone information.

16. A storage medium described in claim 14, characterized in that said threshold value varies in accordance with tone color information contained in said tone information.

17. A storage medium described in claim 14, characterized in that said threshold value can be arbitrarily set by an operation member on a control panel.

18. A storage medium described in claim 12, characterized in that one of said first to third tone components contains a noise component.

19. A storage medium described in claim 12, characterized in that said tone component signal acquisition step includes the step of executing said switching including a filter system outputting said first waveform signal intact as a tone component signal, or a filter type program for outputting said first waveform signal intact as a tone component signal.

20. A storage medium which computer-readably stores processing steps for generating and producing a tone based on tone information by mixing at least first to third tone component signals, characterized in that said processing steps include:

the storage step of storing a first waveform signal in which the first and second tone components are synthesized, in a waveform memory together with a second waveform signal consisting of the third tone component;

the program storage step of storing a first filter type program for cutting said second tone component from said first waveform signal, and a second filter type program for cutting said first tone component from said second waveform signal, in a program memory;

the tone component signal acquisition step of acquiring the first or second tone component signal from said first waveform signal by reading and executing a filter type program to be executed with switching between said first and second filter type programs, on the basis of said tone information; and the tone signal generation step of generating a tone signal based on said tone information by mixing the first or second tone component signal obtained by said tone component signal acquisition step, and the third tone component signal acquired from the second waveform signal of said waveform memory.

21. A storage medium described in claim 20, characterized in that said tone information includes at least one of touch information, pitch information, and tone color information.

22. A storage medium described in claim 20, characterized in that said tone component signal acquisition step includes the step of comparing touch information contained in said tone information and a threshold value set in advance to said touch information, and the step of executing said switching on the basis of the comparison result in said step.

23. A storage medium described in claim 22, characterized in that said threshold value varies in accordance with pitch information contained in said tone information.

24. A storage medium described in claim 22, characterized in that said threshold value varies in accordance with tone color information contained in said tone information.

25. A storage medium described in claim 22, characterized in that said threshold value can be arbitrarily set by an operation member on a control panel.

26. A storage medium described in claim 20, characterized in that one of said first to third tone components contains a noise component.

27. A storage medium described in claim 20, characterized in that said tone component signal acquisition step includes the step of executing said switching including a filter system outputting said first waveform signal intact as a tone component signal, or a filter type program for outputting said first waveform signal intact as a tone component signal.

* * * * *

UNITED STATES PATENT AND TRADEMARK OFFICE

CERTIFICATE OF CORRECTION

PATENT NO. : 6,184,453 B1
DATED : February 6, 2001
INVENTOR(S) : Gen Izumisawa

It is certified that error appears in the above-identified patent and that said Letters Patent is hereby corrected as shown below:

Column 21,
Line 11, replace "generatore" with -- generator --.

Signed and Sealed this

Twenty-third Day of July, 2002

*Attest:*

*Attesting Officer*

JAMES E. ROGAN
*Director of the United States Patent and Trademark Office*